US012385150B1

(12) United States Patent
Jain et al.

(10) Patent No.: US 12,385,150 B1
(45) Date of Patent: Aug. 12, 2025

(54) COMPRESSION CLAMPS FOR ELECTROCHEMICAL STACKS

(71) Applicant: ELECTRIC HYDROGEN CO., Devens, MA (US)

(72) Inventors: Aryan Jain, Somerville, MA (US); Adam McDermott, Lincoln, MA (US); Walter Xu, Kalispell, MT (US)

(73) Assignee: ELECTRIC HYDROGEN CO., Devens, MA (US)

( * ) Notice: Subject to any disclaimer, the term of this patent is extended or adjusted under 35 U.S.C. 154(b) by 0 days.

(21) Appl. No.: 19/027,389

(22) Filed: Jan. 17, 2025

Related U.S. Application Data

(60) Provisional application No. 63/741,662, filed on Jan. 3, 2025.

(51) Int. Cl.
*C25B 9/77* (2021.01)
*C25B 9/63* (2021.01)

(52) U.S. Cl.
CPC . *C25B 9/77* (2021.01); *C25B 9/63* (2021.01)

(58) Field of Classification Search
CPC ..... H01M 8/248; B25B 5/145
USPC ..... 269/43
See application file for complete search history.

(56) References Cited

U.S. PATENT DOCUMENTS

2009/0123792 A1* 5/2009 Reinert ..... H01M 8/12 429/533
2010/0143765 A1* 6/2010 Chen ..... H01M 8/2475 429/461
2023/0268543 A1* 8/2023 Woo ..... H01M 8/2457 429/400
2024/0339646 A1* 10/2024 Vulliez ..... C25B 1/042

FOREIGN PATENT DOCUMENTS

DE 102006015118 A1 * 10/2007 ..... H01M 8/02
EP 2434570 B1 * 11/2017 ..... C25B 9/20
EP 3955353 A1 * 2/2022 ..... C25B 1/042
KR 20230130410 A * 9/2023 ..... H01M 8/2484
WO WO-2004077587 A2 * 9/2004 ..... H01M 8/04007
WO WO-2020229250 A1 * 11/2020
WO WO-2024133114 A1 * 6/2024 ..... C25B 9/77
WO WO-2025049318 A2 * 3/2025

OTHER PUBLICATIONS

Machine translation of KR 20230130410-A (Year: 2023).*
Machine translation of WO 2020229250 A1 (Year: 2020).*
Machine translation of WO 2024133114 A1 (Year: 2024).*
Machine translation of EP 3955353 A1 (Year: 2022).*
Machine translation of EP 2434570 B1 (Year: 2017).*
Machine translation of WO 2004/077587 A2 (Year: 2004).*

* cited by examiner

*Primary Examiner* — Harry D Wilkins, III
(74) *Attorney, Agent, or Firm* — Lempia Summerfield Katz LLC

(57) ABSTRACT

The following disclosure relates to a compression tool for compressing a substack of electrochemical cells having a first plate, a second plate, and a plurality of electrochemical cells positioned between the first plate and the second plate. The compression tool is configured to be maintain on the substack after the substack is added to the electrochemical stack assembly and the electrochemical stack assembly commences operation of an electrolysis reaction.

20 Claims, 18 Drawing Sheets

COMPRESSION CLAMPS FOR ELECTROCHEMICAL STACKS

This application claims the benefit of U.S. Provisional Patent Application No. 63/741,662, filed Jan. 3, 2025, which is hereby incorporated by reference in its entirety.

FIELD

The following disclosure relates to electrochemical devices, systems, and components thereof. More specifically, the following disclosure relates to compression clamps for electrochemical stacks.

BACKGROUND

Hydrogen has been considered as an ideal energy carrier to store renewable energy. Proton exchange membrane water electrolysis (PEMWE) as a means for hydrogen production offers high product purity, fast load response times, small footprints, high efficiencies, and low maintenance efforts. It is regarded as a promising technology, especially when coupled with renewable energy sources.

An electrolysis cell or system uses electrical energy to drive a chemical reaction. For example, water is split to form hydrogen and oxygen. The products may be used as energy sources for later use. In recent years, improvements in operational efficiency have made electrochemical systems competitive market solutions for energy storage, generation, and/or transport. For example, the cost of generation may be below $6 per kilogram of hydrogen in some cases. Increases in efficiency and/or improvements in operation will continue to drive the installation of electrochemical systems.

An electrochemical stack may include a plurality of substacks, each including a plurality of individual electrochemical cells. Temporary clamps may be placed on an assembled substack to provide compression on the substack and a method for transporting the assembled substack to install the substack within the overall electrochemical stack. However, due to their cumbersome nature, the temporary clamps must be removed after the stack has been assembled. Therefore, there is no structure in place to keep the substacks aligned within the overall stack throughout the electrolysis reaction. Additionally, removal of each individual substack from the overall stack may be challenging as well.

Therefore, there remains a desire for an improved compression tool for a substack to improve compressibility, maintain alignment throughout an electrolysis reaction, and provide improved installation and removal from the overall electrochemical stack.

SUMMARY

In one embodiment, a compression tool is provided for compressing a substack of electrochemical cells having a first plate, a second plate, and a plurality of electrochemical cells positioned between the first plate and the second plate. The compression tool includes a first clamp component having a first cavity and a hole at a base of the first cavity. The first clamp component is configured to be positioned within a recess on an outer surface of the first plate of the substack such that the hole at the base of the first cavity is positioned toward a second clamp component of the compression tool. The compression tool also includes the second clamp component having a second cavity and a hole at a base on the second cavity. The depth of the second cavity is greater than a depth of the first cavity. The second clamp component is configured to be positioned within a recess on an outer surface of the second plate of the substack such that the hole at the base of the second cavity is positioned toward the first clamp component. The compression tool also includes a fastener having a head at a first end and a body, wherein the body is configured to be positioned through the hole of the first clamp component and the hole of the second clamp component, and wherein the head is positioned within the first cavity of the first clamp component. The compression tool also includes a retaining component configured to be attached to or threaded onto the fastener and positioned within the second cavity of the second clamp component such that the hole at the base of the second cavity is positioned between the first clamp component and the retaining component. The retaining component is configured to be adjusted on the fastener within the second cavity to provide a first compression of the plurality of electrochemical cells within the substack outside of an electrochemical stack assembly having a plurality of substacks. The compression tool is configured to be maintained on the substack after the substack is added to the electrochemical stack assembly and the electrochemical stack assembly commences operation of an electrolysis reaction.

In another embodiment, a substack for an electrochemical stack is provided. The substack includes a plurality of electrochemical cells, a first plate, a second plate, and a compression tool. The plurality of electrochemical cells is positioned between the first plate and the second plate. The compression tool includes a first clamp component having a first cavity and a hole at a base of the first cavity. The first clamp component is positioned within a recess on an outer surface of the first plate of the substack such that the hole at the base of the first cavity is positioned toward a second clamp component of the compression tool. The compression tool also includes the second clamp component having a second cavity and a hole at a base on the second cavity. The depth of the second cavity is greater than a depth of the first cavity. The second clamp component is positioned within a recess on an outer surface of the second plate of the substack such that the hole at the base of the second cavity is positioned toward the first clamp component. The compression tool also includes a fastener having a head at a first end and a body, wherein the body is configured to be positioned through the hole of the first clamp component and the hole of the second clamp component, and wherein the head is positioned within the first cavity of the first clamp component. The compression tool also includes a retaining component configured to be attached to or threaded onto the fastener and positioned within the second cavity of the second clamp component such that the hole at the base of the second cavity is positioned between the first clamp component and the retaining component. The retaining component is configured to be adjusted on the fastener within the second cavity to provide a first compression of the plurality of electrochemical cells within the substack outside of an electrochemical stack assembly having a plurality of substacks. The compression tool is configured to be maintained on the substack after the substack is added to the electrochemical stack assembly and the electrochemical stack assembly commences operation of an electrolysis reaction.

In another embodiment, a method for forming a substack with a compression tool for an electrochemical stack is provided. The method includes providing a substack comprising a plurality of electrochemical cells, a first plate, and a second plate wherein the plurality of electrochemical cells is positioned between the first plate and the second plate. The method further includes positioning a first clamp component having a first cavity and a hole at a base of the first cavity, within a recess on an outer surface of the first plate of the substack and positioning the first cavity toward a second clamp component. The method further includes positioning the second clamp component, having a second cavity and a hole at a base on the second cavity wherein a depth of the second cavity is greater than a depth of the first cavity, within a recess on an outer surface of the second plate of the substack and positioning the hole at the base of the second cavity toward the first clamp component. The method further includes positioning a body of a threaded fastener having a head at a first end of the threaded fastener and thread extending along at least a portion of a body of the threaded fastener, through the hole of the first clamp component and the hole of the second clamp component and positioning the head of the threaded fastener within the first cavity of the first clamp component. The method further includes positioning a retaining component onto the thread of the threaded fastener within the second cavity of the second clamp component. The method further includes positioning the hole at the base of the second cavity between the first clamp component and the tightening nut. The method further includes adjusting the retaining component on the thread of the threaded fastener within the second cavity to provide a first compression of the plurality of electrochemical cells within the substack outside of an electrochemical stack assembly having a plurality of substacks. The method further includes adding the substack to the electrochemical stack assembly, wherein the compression tool is maintained on the substack after the substack is added to the electrochemical stack assembly and the electrochemical stack assembly commences operation of an electrolysis reaction.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Exemplary embodiments are described herein with reference to the following drawings.

DETAILED DESCRIPTION

Compression tools may provide partial compression on a substack of electrochemical cells during manufacture and installation of the substack within an electrochemical stack. While conventional compression tools need to be removed from the substack following installation in the overall stack, the present disclosure provides an improved compression tool that may advantageously remain coupled to the substack after installation in the overall stack and throughout operation of the electrochemical stack to provide continuous compression throughout an electrolysis reaction, maintain alignment of the cells within the substack, and provide improved removal from the stack for maintenance.

The following disclosure provides such an improved compression tool for compressing a substack of electrochemical cells. Specifically, the following disclosure provides a compression tool for compressing a substack of electrochemical cells having a first plate, a second plate, and a plurality of electrochemical cells positioned between the first plate and the second plate.

Such compression tools may stay coupled to a substack after the substack is formed to ensure partial compression of the substack throughout the life of the substack. This allows the electrochemical cells inside a substack to not move during the various processes throughout the electrolysis reaction. This compression tool also provides that the substack stays aligned and also provides better full stack alignment when building an electrochemical stack. This can also result in lower manufacturing failures during the electrochemical stack assembly.

The compression tool allows the ability to measure the compression in a substack in terms of displacement of the substack. It also allows for the ability to measure the compression within each substack in a full stack and correlate that to performance of individual cells. This may also provide explanations as to which substacks are being more compressed than others.

Electrochemical Cells

Figure 1:
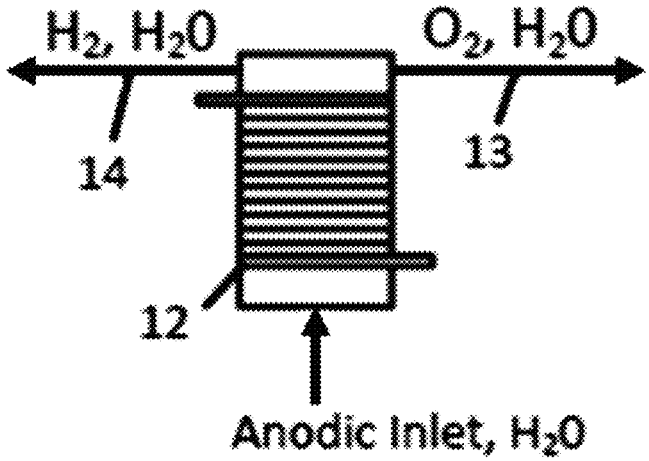
FIG. 1 depicts an example of an electrochemical system including an electrochemical stack having a plurality of electrochemical cells.

FIG. 1 depicts an example of an electrochemical system including an electrochemical stack having a plurality of electrochemical cells. In certain examples, the electrochemical stack may contain 50-1000 cells, 50-100 cells, 500-700 cells, or more than 1000 cells. Any number of cells may make up a stack. The electrochemical cells within the electrochemical stack may be configured to operate with 200 mV or less of pure resistive loss when operating at a high current density (e.g., at least 3 Amps/cm$^2$, at least 4 Amps/cm$^2$, at least 5 Amps/cm$^2$, at least 6 Amps/cm$^2$, at least 7 Amps/cm$^2$, at least 8 Amps/cm$^2$, at least 9 Amps/cm$^2$, at least 10 Amps/cm$^2$, at least 11 Amps/cm$^2$, at least 12 Amps/cm$^2$, at least 13 Amps/cm$^2$, at least 14 Amps/cm$^2$, at least 15 Amps/cm$^2$, at least 16 Amps/cm$^2$, at least 17 Amps/cm$^2$, at least 18 Amps/cm$^2$, at least 19 Amps/cm$^2$, at least 20 Amps/cm$^2$, at least 25 Amps/cm$^2$, at least 30 Amps/cm$^2$, in a range of 1-30 Amps/cm$^2$, in a range of 3-20 Amps/cm$^2$, in a range of 3-15 Amps/cm$^2$, in a range of 3-10 Amps/cm$^2$, or in a range of 10-20 Amps/cm$^2$). In additional examples, the amount of water (e.g., deionized (DI) water)

transferred to or circulated through each cell of the stack may be in a range of 0.25-1 mL/Amp/cell/min, in a range of 0.25-5 mL/Amp/cell/min, or in a range of 0.5-1 mL/Amp/cell/min.

As illustrated in the system of FIG. 1, water ($H_2O$) may be supplied to the anodic inlet of an electrolytic cell stack 12. In some embodiments, only the anodic inlet of the cell stack 12 may receive water. In these embodiments, the cathode side of the cell stack 12 may not receive water (e.g., a dry cathode side may be used). In another embodiment, a cathode inlet may also receive water, wherein the water may be supplied to the cathode inlet to cool the cell stack 12 during electrolysis.

The water supplied to the anodic inlet flows to an anodic inlet manifold that distributes the water to the anode side of the plurality of cells contained with the cell stack 12. In embodiments where water is supplied to the cathode inlet, water supplied to the cathode inlet flows to a cathodic inlet manifold that distributes the water to the cathode side of the plurality of cells in the cell stack 12. In certain examples, the amount of water (e.g., deionized (DI) water) transferred to or circulated through each cell of the stack may be in a range of 0.25-5 mL/Amp/cell/min.

During electrolysis, oxygen ($O_2$) is produced at the anode side of the electrolytic cells and hydrogen ($H_2$) is produced at the cathode side of the electrolytic cells. Specifically, a water splitting electrolysis reaction is configured to take place within each individual cell in the cell stack 12. Each cell includes one interface (the anode side of the cell) configured to run an oxygen evolution reaction (OER) and another interface (the cathode side of the cell) configured to run a hydrogen evolution reaction (HER) (such as depicted in FIG. 2).

During electrolysis, some of the water supplied to the anode side of an electrolytic cell may not be split into oxygen. Accordingly, a two-phase flow of oxygen and unreacted water is outlet from each of the anode sides of the cells into an anodic outlet manifold 13. The two-phase flow of oxygen and unreacted water flows from out of the cell stack 12 through the anodic outlet manifold 13. This stream within the anodic outlet manifold 13 may be configured to be transferred to a gas detection and conditioning system, such as described in greater detail below, for analysis of the composition within the stream. Specifically, this anodic stream may be analyzed to identify if any undesirable hydrogen gas has leaked (i.e., cross-leaked) across the membranes from the cathode sides of the cells to the anode sides of the cells within the cell stack.

Additionally, in some embodiments, water may be supplied to the cathode side of the cell stack as a coolant. Accordingly, a two-phase flow of hydrogen and water is outlet from each of the cathode sides of the cells to a cathodic outlet manifold 14. The two-phase flow of hydrogen and water flows out of the cell stack 12 through the cathodic outlet manifold 14. Similarly, this particular stream within the cathodic outlet manifold 14 may be configured to be transferred to a gas detection and conditioning system (separate from the anodic gas detection and conditioning system) for analysis of the composition within the stream. Specifically, this cathodic stream may be analyzed to identify if any undesirable oxygen gas has leaked (i.e., cross-leaked) across the membranes from the anode sides of the cells to the cathode sides of the cells within the cell stack.

Figure 2:
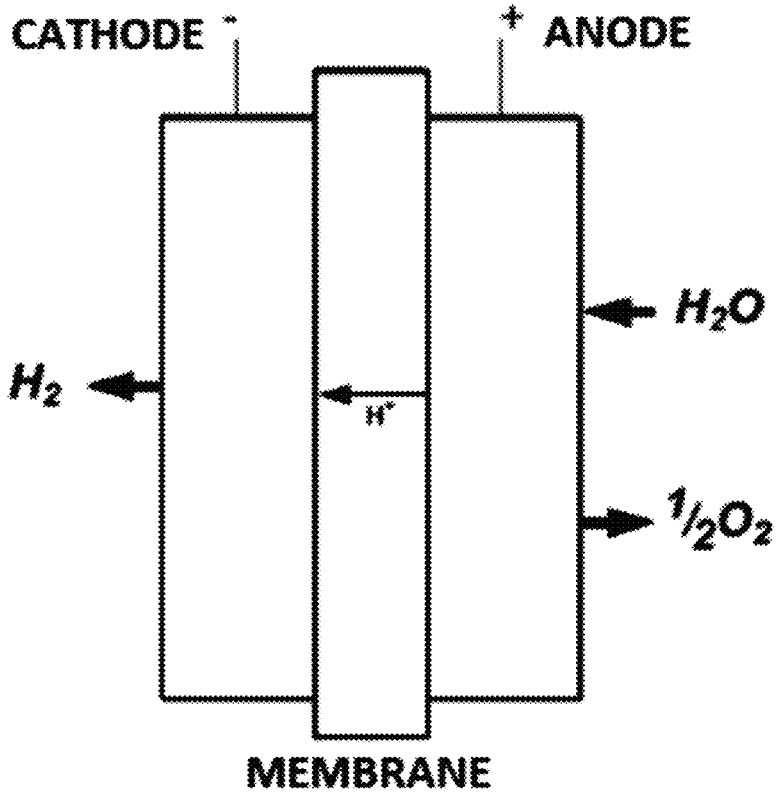
FIG. 2 depicts an example of an electrochemical cell.

FIG. 2 depicts an example of an electrochemical or electrolytic cell for hydrogen gas and oxygen gas production through the splitting of water. The electrochemical cell within FIG. 2 may be one of the plurality of cells within the electrochemical stack in FIG. 1. The electrochemical cell includes a cathode, an anode, and a membrane positioned between the cathode and anode. The membrane may be a proton exchange membrane (PEM) that may have a catalyst coating on one or both surfaces of the PEM. In other examples, the membrane may be positioned within an electrochemical cell having a catalyst coating on an adjacent supporting layer within the cell (e.g., a gas diffusion layer or porous transport layer near or abutting the membrane).

Proton Exchange Membrane (PEM) electrolysis involves the use of a solid electrolyte or ion exchange membrane. Within the water splitting electrolysis reaction, one interface runs an oxygen evolution reaction (OER) while the other interface runs a hydrogen evolution reaction (HER). For example, the anode reaction is $H_2O \rightarrow 2H^+ + \frac{1}{2}O_2 + 2e$ and the cathode reaction is $2H^+ + 2e \rightarrow H_2$.

Figure 3:
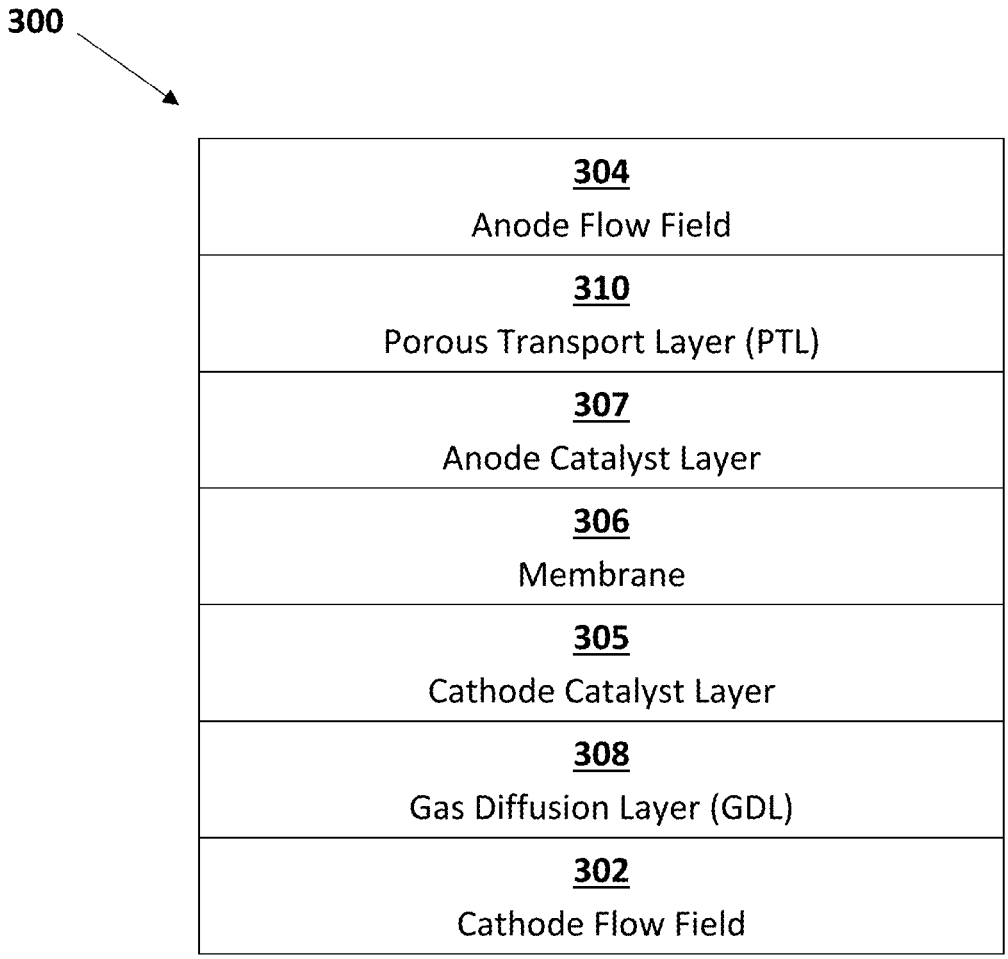
FIG. 3 depicts an additional example of an electrochemical cell.

FIG. 3 depicts an additional example of an electrochemical or electrolytic cell 300. Specifically, FIG. 3 depicts a portion of an electrochemical cell 300 having a cathode flow field 302, an anode flow field 304, and a membrane 306 positioned between the cathode flow field 302 and the anode flow field 304. In certain examples, the membrane 306 may have an overall thickness that is less than 1000 microns, 500 microns, 100 microns, 50 microns, 10 microns, etc.

In certain examples, additional layers may be present within the electrochemical cell 300. For example, one or more additional layers 308 may be positioned between the cathode flow field 302 and membrane 306. In certain examples, this may include a gas diffusion layer (GDL) 308 that may be positioned between the cathode flow field 302 and membrane 306. This may be advantageous in providing a hydrogen diffusion barrier adjacent to the cathode on one side of the multi-layered membrane to mitigate hydrogen crossover to the anode side. In other words, the GDL is responsible for the transport of gaseous hydrogen to the cathode side flow field. For a wet cathode PEM operation, liquid water transport across the GDL is needed for heat removal in addition to heat removal from the anode side.

Similarly, one or more additional layers 310 may be present in the electrochemical cell between the membrane 306 and the anode flow field 304. In certain examples, this may include a porous transport layer (PTL) positioned between the membrane 306 (e.g., the anode catalyst layer 307 of the catalyst coated membrane 306) and the anode flow field 304.

Similar to the GDL, the PTL is configured to allow the transportation of the reactant water to the anode catalyst layers, remove produced oxygen gas, and provide good electrical conductivity for effective electron conduction. In other words, liquid water flowing in the anode flow field is configured to permeate through the PTL to reach the CCM. Further, gaseous byproduct oxygen is configured to be removed from the PTL to the flow fields. In such an arrangement, liquid water functions as both reactant and coolant on the anode side of the cell.

In some examples, an anode catalyst coating layer may be positioned between the anode flow field 304 and the PTL.

The cathode flow field 302 and anode flow field 304 of the cell may individually include a flow field plate composed of metal, carbon, or a composite material having a set of channels machined, stamped, or etched into the plate to allow fluids to flow inward toward the membrane or out of the cell.

In order to achieve desired system performance, multiple cells may be placed together to form a "stack" of cells, which may be referred to as an electrochemical stack, electrolytic stack, electrochemical stack, or simply just a stack. In one example, a stack may contain 50-1000 cells, 50-100 cells, 500-700 cells, or more than 1000 cells. Any number of cells may make up a stack.

Further, as noted below, the electrochemical stack may include a plurality of substacks making up a portion less than all of the entire stack, wherein each substack includes a plurality of electrochemical cells bookended by a cathode (unipolar) plate and an anode (unipolar) plate such that the cathode and anode plates define the boundaries of each substack. In certain examples, a substack may include at least 2 cells, at least 3 cells, at least 4 cells, at least 5 cells, at least 10 cells, less than or equal to 100 cells, less than or equal to 50 cells, less than or equal to 30 cells, less than or equal to 25 cells, less than or equal to 20 cells, in a range of 2-100 cells, in a range of 3-50 cells, in a range of 4 to 30 cells, in a range of 5-25 cells, or in a range of 10-20 cells stacked on top of one another in the electrochemical system to provide an electrochemical stack.

Electrochemical Substack

Figure 4:
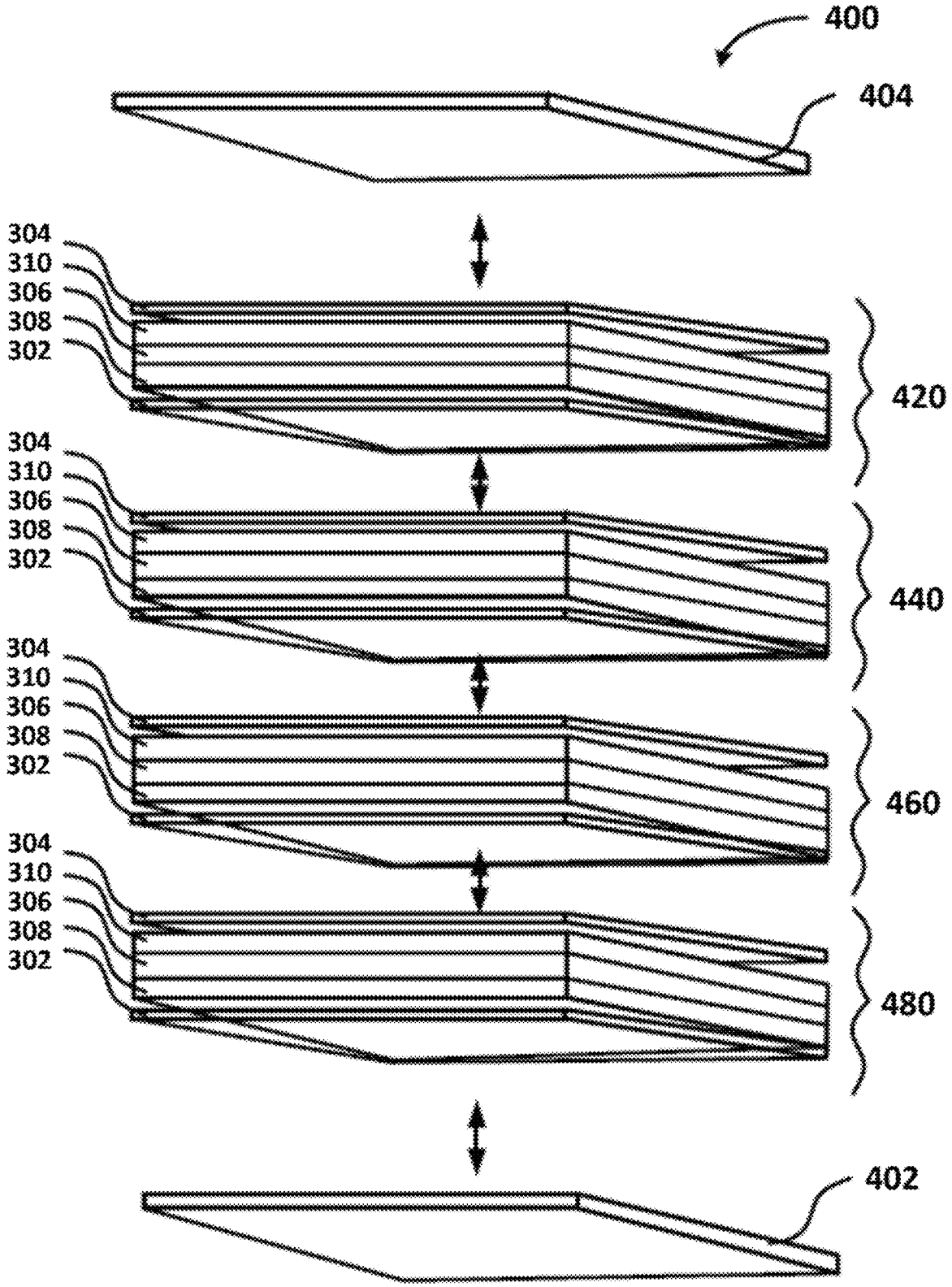
FIG. 4 depicts, in an exploded view, an example of a substack of an electrochemical stack.

FIG. 4 depicts, in an exploded view, an example of a substack 400 of an electrochemical stack. The substack 400 includes four electrochemical cells stacked on top of one another (e.g., connecting, abutting, or the like): a first electrochemical cell 420, a second electrochemical cell 440, a third electrochemical cell 460, and a fourth electrochemical cell 480.

In certain examples, the substack 400 is not limited to four electrochemical cells. Instead, the substack may include any plurality of electrochemical cells as defined above. For example, a substack may include at least 2 cells, at least 3 cells, at least 4 cells, at least 5 cells, at least 10 cells, less than or equal to 100 cells, less than or equal to 50 cells, less than or equal to 30 cells, less than or equal to 25 cells, less than or equal to 20 cells, in a range of 2-100 cells, in a range of 3-50 cells, in a range of 4 to 30 cells, in a range of 5-25 cells, or in a range of 10-20 cells stacked on top of one another in the electrochemical system to provide an electrochemical stack.

Each electrochemical cell (i.e., electrochemical cells 420, 440, 460, and 480) of the substack 400 includes a cathode flow field 302, an anode flow field 304, and a membrane 306 positioned between the cathode flow field 302 and the anode flow field 304. As noted above, the cathode flow field 302 and anode flow field 304 of each cell may individually include a flow field plate composed of metal, carbon, or a composite material having a set of channels machined, stamped, or etched into the plate to allow fluids to flow inward toward the membrane or out of the cell.

In certain examples, each cell may include additional layers such as a gas diffusion layer (GDL) 308 and a porous transport layer (PTL) 310, such as those layers described with reference to the electrochemical cell in FIG. 3. For instance, the GDL 308 may be positioned between the cathode flow field 302 and the membrane 306. On the opposite side of the cell, the PTL 310 may be present in each electrochemical cell between the membrane 306 and the anode 304. Additionally, in certain examples, the membrane 306 may be a catalyst coated membrane (CCM) having a cathode catalyst layer 305 and/or an anode catalyst layer 307 positioned on respective surfaces of the membrane 306. However, in terms of simplicity, these additional layers are not illustrated in FIG. 4.

As mentioned above, the substack 400 includes multiple cells stacked on top of one another. More particularly, the first electrochemical cell 420 is stacked on top of a second electrochemical cell 440. The second electrochemical cell 440 is stacked on top of the third electrochemical cell 460, and the third electrochemical cell 460 is stacked on top of the fourth electrochemical cell 480.

As depicted in FIG. 4, the cathode flow field 302 of the first electrochemical cell 420 is positioned adjacent to the anode flow field 304 of the second electrochemical 440. The cathode flow field 302 of the second electrochemical cell 440 is positioned adjacent to the anode flow field 304 of the third electrochemical cell 460. Additionally, the cathode flow field 302 of the third electrochemical cell 460 is positioned adjacent to the anode flow field of the fourth electrochemical cell 480.

The substack 400 also includes two plates 402, 404 positioned on opposite ends of the substack 400, therein serving as the termination points for the electrical connection of the substack. The plates may be unipolar plates, i.e., a cathode unipolar plate 402 and an anode unipolar plate 404, positioned on opposite ends of the substack 400.

In other words, the multiple cells (i.e., 420, 440, 460, and 480) are positioned between the anode unipolar plate 404 and the cathode unipolar plate 402, such as to enclose the plurality of cells. For example, the anode flow field 304 of the first electrochemical cell 420 abuts the internal surface of the anode unipolar plate 404. As noted above, the anode flow field 304 and the anode unipolar plate 404 may be a single structure (i.e., the flow fields or channels are etched, carved, or otherwise formed on one surface of the anode unipolar plate).

Likewise, the cathode flow field 302 of the fourth electrochemical cell 480 abuts the internal surface of the cathode unipolar plate 402. Again, in some examples, the cathode flow field 302 and the cathode unipolar plate 402 may be a single structure (i.e., the flow fields or channels are etched, carved, or otherwise formed on one surface of the anode unipolar plate).

The unipolar plates may be made of any metal or metal alloy suitable to withstand an electrolysis environment. In one particular example, the unipolar plates include titanium or a titanium alloy, which may advantageously provide strength and durability at a small thickness, therein not unduly increasing the height of the substack and overall stack. Specifically, in some examples, the thickness or height of each unipolar plate may be at least 0.1 mm, at least 1 mm, less than or equal to 10 mm, less than or equal to 5 mm, less than or equal to 3 mm, in a range of 0.1-10 mm, in a range of 1-5 mm, or in a range of 1-3 mm. The unipolar plates advantageously enclose the plurality of cells to form the substack 400.

Compression Tool

FIGS. 5A-5E depict an example of a compression tool 500 for compressing a substack of electrochemical cells having a first plate, a second plate, and a plurality of electrochemical cells positioned between the first plate and the second plate. In certain examples, the first plate and the second plate may be first and second unipolar plates as described above in FIG. 4.

As noted above, the compression tool 500 is advantageous over the state of the art in that the compression tool may be configured to be maintained on the substack after the substack is added to the electrochemical stack assembly and the electrochemical stack assembly commences operation of an electrolysis reaction. This provides several advantages including providing a level of compression on the electrochemical cell layers of the substack following assembly prior to insertion into the overall stack, during inclusion within the overall stack, and following removal from the overall stack. This may allow the cell layers within the plurality of electrochemical cells in the substack to remained within alignment following assembly, as the compression tool is not removed following insertion into the overall stack. Additionally, by maintaining the compression tool on the substack following insertion into the overall stack, the substack may advantageously be more easily removed from the overall stack for maintenance.

Figure 5A:
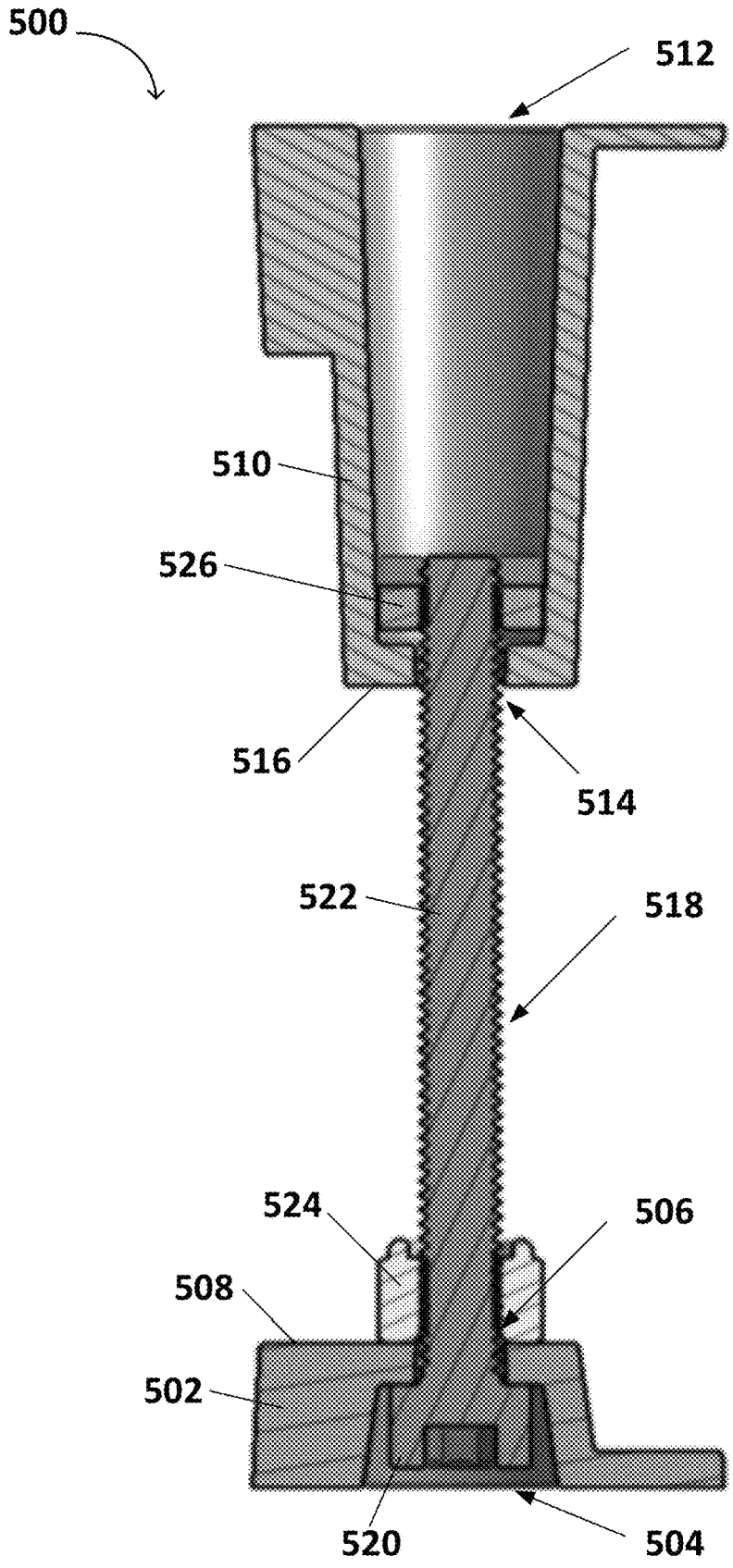
FIGS. 5A-5E depict examples of compression tools for compression of a substack.

As depicted in FIG. 5A, the compression tool 500 may include a first clamp component 502 having a first cavity 504 and a hole 506 as a base 508 of the first cavity 504. In certain examples, the first clamp component may be configured to be positioned within a recess or pocket on an outer surface of the first plate of the substack such that the hole 506 at the base 508 of the first cavity 504 may be positioned toward a second clamp component 510 of the compression tool. This may be advantageous in not adding any additional height to the substack when the first clamp component 502 is added to the substack. That is, by positioning the first clamp component 502 within a recess or pocket in the plate of the substack, the thickness of the portion of the first clamp component 502 abutting the first plate within the recess/pocket does not extend beyond the outer surface of the first plate.

The compression tool 500 may include a second clamp component 510 having a second cavity 512 and a hole 514 at a base 516 on the second cavity 512. In certain examples, a depth of the second cavity (as measured in a direction from the first plate to the second plate or a direction from the second clamp component to the first clamp component) may be greater than a depth of the first cavity. In certain examples, the second clamp component 510 may be configured to be positioned within a recess or pocket on an outer surface of the second plate of the substack such that the hole 514 at the base 516 of the second cavity 512 may be positioned toward the first clamp component 502. Again, this may be advantageous in not adding any additional height to the substack when the second clamp component 510 is added to the substack. That is, by positioning the second clamp component 510 within a recess or pocket in the plate of the substack, the thickness of the portion of the second clamp component 510 abutting the second plate within the recess/pocket does not extend beyond the outer surface of the second plate.

The compression tool may include a fastener (e.g., a threaded fastener) 518 configured to connect the first and second clamp components 502, 510 with each other, therein assisting in securing or holding the substack positioned between the two clamp components. In certain examples, the fastener 518 may include a machined stud or a bolt 520 having a thread 522 extending along at least a portion of the body of the machined stud or bolt. In certain examples, the bolt is a carriage bolt, hex bolt, stove bolt, or machine bolt. In certain alternative examples, the fastener contains no thread extending along the body of the component.

Further, the fastener 518 may include a retaining component 524 such as a ring, clip, or nut used in conjunction with the machined stud or bolt to fasten the parts together. In certain examples, the retaining ring or clip may be a c-clip. In other examples, the nut may be a dome nut, hex nut, or flange nut, for example.

While FIGS. 5A-5E depict examples of bolt and nut combinations, these principles may extend to other fastener examples as well, such as machined stud and c-clip combinations.

As depicted in FIG. 5A, the bolt 518 includes a head 520 at a first end of the bolt and a thread 522 extending along at least a portion of a body of the bolt. The body of the bolt 518 may be configured to be positioned through the hole 506 of the first clamp component 502 and the hole 514 of the second clamp component 510, and wherein the head 520 of the bolt 518 may be positioned within the first cavity 504 of the first clamp component 502.

The compression tool may include a tightening nut 526 that may be configured to be threaded onto the thread of the bolt 518 and positioned within the second cavity 512 of the second clamp component 510 such that the hole 514 at the base 516 of the second cavity 512 may be positioned between the first clamp component 502 and the tightening nut 526. The tightening nut 526 may be configured to be adjusted on the thread of the bolt 518 within the second cavity 512 to provide a first compression of the plurality of electrochemical cells within the substack outside of an electrochemical stack assembly having a plurality of substacks. In other words, the positioning of the tightening nut 526 on the threaded body 522 of the bolt 518 may be adjusted on the threaded body 522 to provide or modify a desired compression on the substack positioned between the two clamp components connected by the fastener/bolt 518.

In certain examples, the compression tool 500 may include a lock nut 524 that may be configured to be threaded onto the thread of the bolt 518 to secure the first clamp component 502 between the head 520 of the bolt 518 and the lock nut 524. In practice, the lock nut 524 would be positioned on the threaded bolt prior to the inclusion of the second clamp component 510. In other words, the body 522 of the threaded bolt 518 may be positioned through the hole 506 of the first clamp component 502, and the lock nut 524 may then be fastened onto the body 522 of the bolt 518 to secure the first clamp component 502 between the head 520 of the bolt 518 and the lock nut 524. Subsequent to securing the first clamp component 502 in place, the first clamp component 502 may be positioned within the recess or pocket of the first plate of the substack and further secured with the second clamp component 510 and tightening nut 526 as described above.

In certain examples, the compression tool may include a spring mechanism, e.g., attached to at least one of the clamp components. Such a spring mechanism may be advantageous in providing a preload to the compression tool to assist in installation of the compression tool on the substack.

Figure 5B:
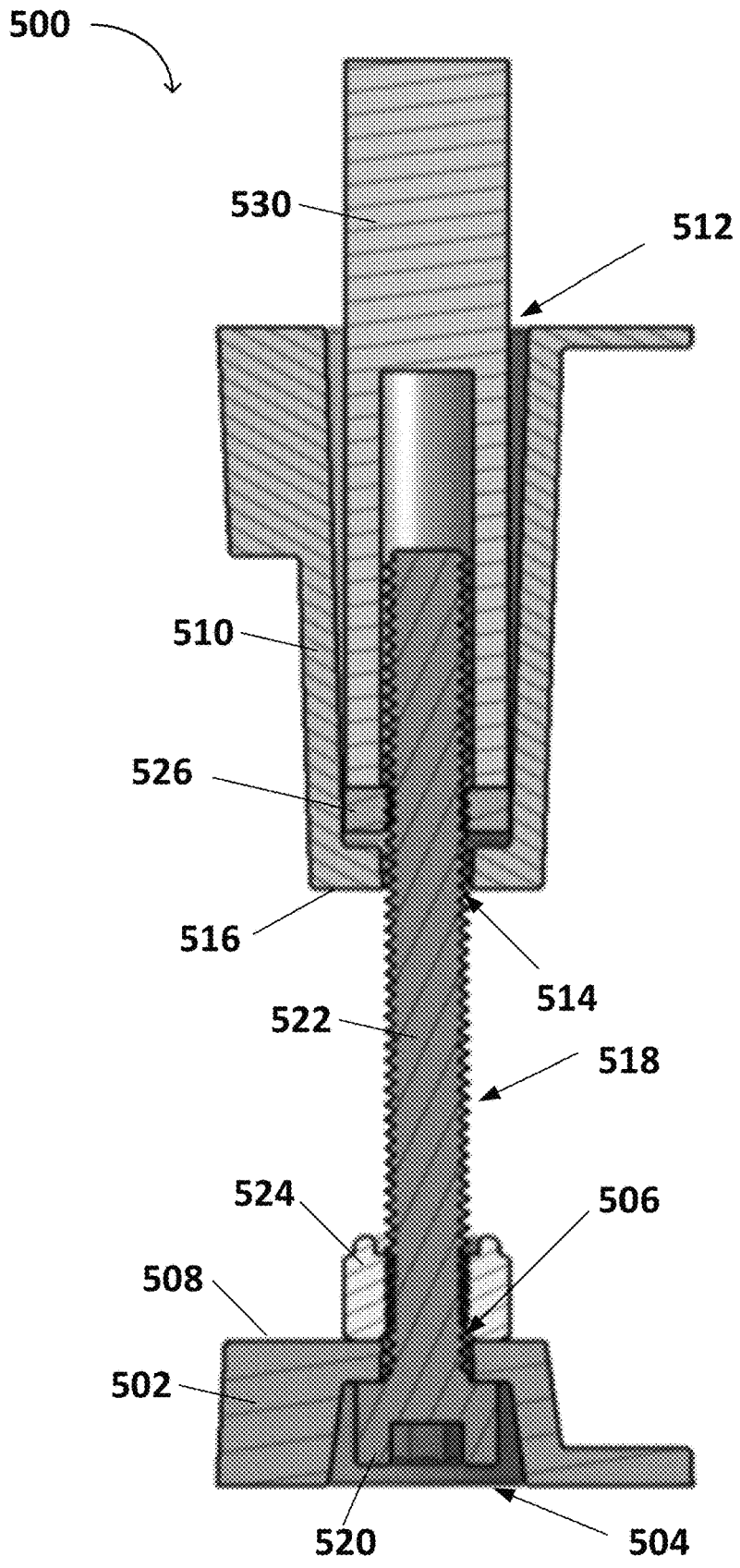

As depicted in FIG. 5B, the compression tool 500 may include a tightening tool 530 configured to assist in securing the tightening nut 526 on the threaded bolt 518 within the recess 512 of the second clamp component 510. In certain examples, after placing the tightening nut 526 on the threaded bolt 518, the compression or tightening tool 530 may be aligned with the tightening nut 526 to move the tightening nut 526 down the threaded bolt 518 toward the first clamp component 502 to compress the substack between the two clamp components. In certain examples, the compression or tightening tool 530 may be configured to grip or clamp onto the tightening nut 526 to screw the tightening nut 526 and compress the substack. In some examples, the compression or tightening tool 530 may also be configured to grip or clamp onto the tightening nut 526 to unscrew or loosen the compression on the substack. In one particular example, such as depicted in FIG. 5B, the compression or tightening tool 530 may be threaded onto the thread of the bolt 518 at a second end of the bolt opposite the first end or head 520 of the bolt 518 (after the tightening nut 526 has been attached to the thread of the bolt 518). The tightening tool 530 may then be configured to be twisted or moved in a clockwise direction to abut the tightening nut 526 and move the tightening nut 526 in the same direction to tighten the tightening nut 526 to compress the substack.

In certain examples, the tightening nut 526 may be tightened along the body 522 of the bolt 518 to a predetermined height. This may provide a desired or a first compression on the plurality of electrochemical cells of the substack. The tightening tool 530 may be configured to be removed from the compression tool 500 after the substack has been compressed to the predetermined height.

In certain examples, the compression tool 530 may include a spacer configured to be inserted into an opening between the first clamp component 502 and the second clamp component 510 to set the predetermined height.

Figure 5C:
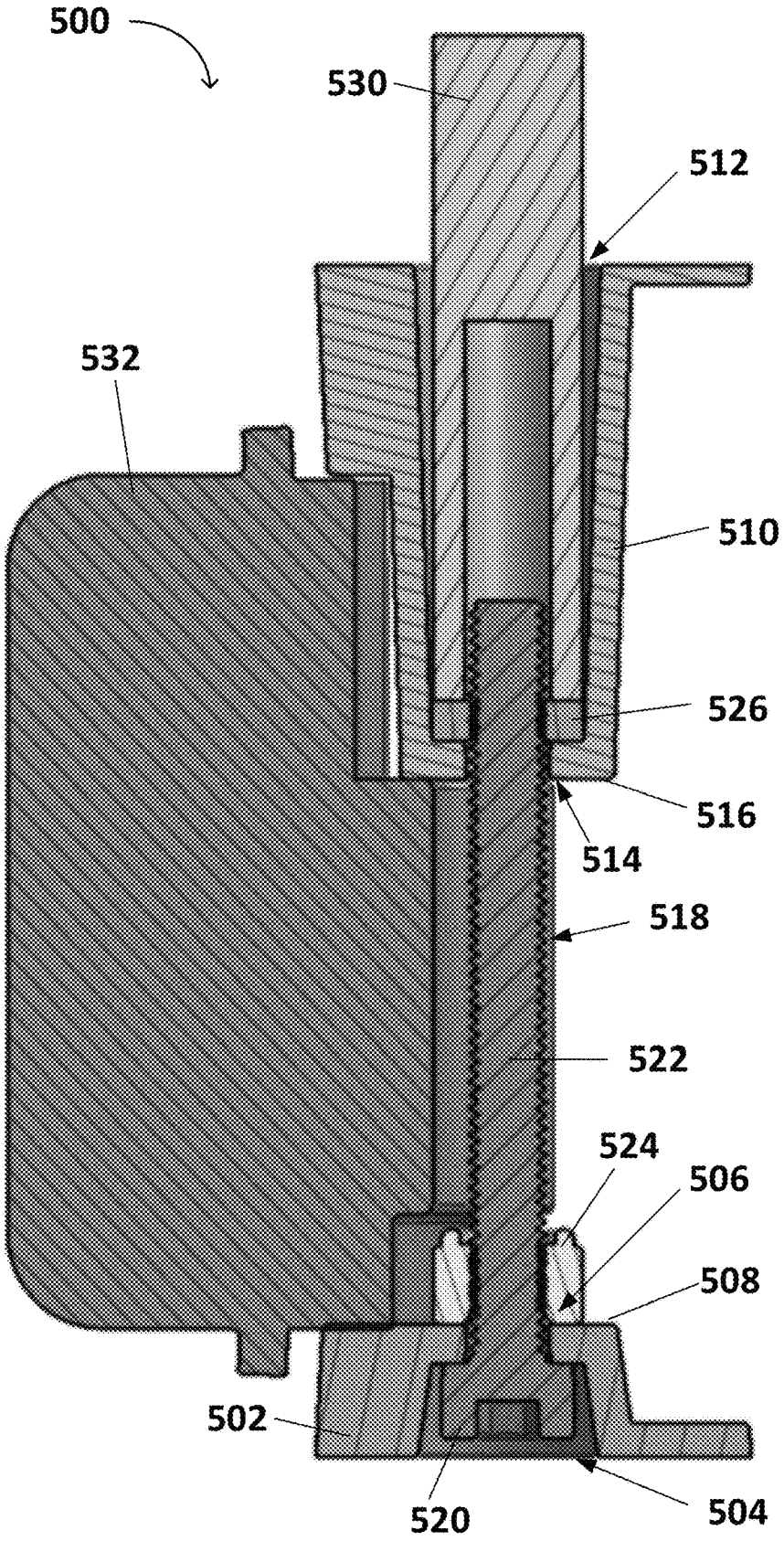

FIG. 5C depicts an example of a spacer 532 being used with the compression tool 500. In this example, the spacer 532 may be inserted prior to twisting or moving the tightening nut 526 down the body 522 of the bolt 518 toward the first clamp component 502. After the first clamp component 502 and second clamp component 510 move towards each other a certain distance, the first and second clamp components may begin to abut the centrally positioned spacer 532, therein identifying that the tightening nut 526 and abutting second clamp component 510 have reached the desired/predetermined height for compressing the substack.

In certain examples, a plurality of different spacers with different sizes/heights may be provided. This may be advantageous for providing different substack heights for substacks having a different number of cells. In other words, a first spacer may be provided for a substack having four electrochemical cells such that the predetermined height for compression is appropriately scaled for four cells, while a second spacer may be provided for a substack of five electrochemical cells with a different associated predetermined height that provides a similar initial/first compression. As such, depending on the number of cells within the substack, a spacer 532 can be configured to provide and guide the tightening of the tightening nut 526 to a predetermined height associated with that number of cells in the substack for the initial/first compression of the stack. This is advantageous in limiting user/operator error in overly tightening the tightening nut 526 and either warping the first or second plates of the substack or overly compressing the substack prior to insertion into the overall stack. The spacer 532 is also advantageous in avoiding user/operator error in under tightening the tightening nut 526 and under compressing the substack, therein potentially leading to shifting of cell layers within the substack during movement/insertion of the substack into the overall stack.

In certain examples, the spacer 532 may be configured to be removed from the compression tool 500 after the substack has been compressed to the predetermined height.

Figure 5D:
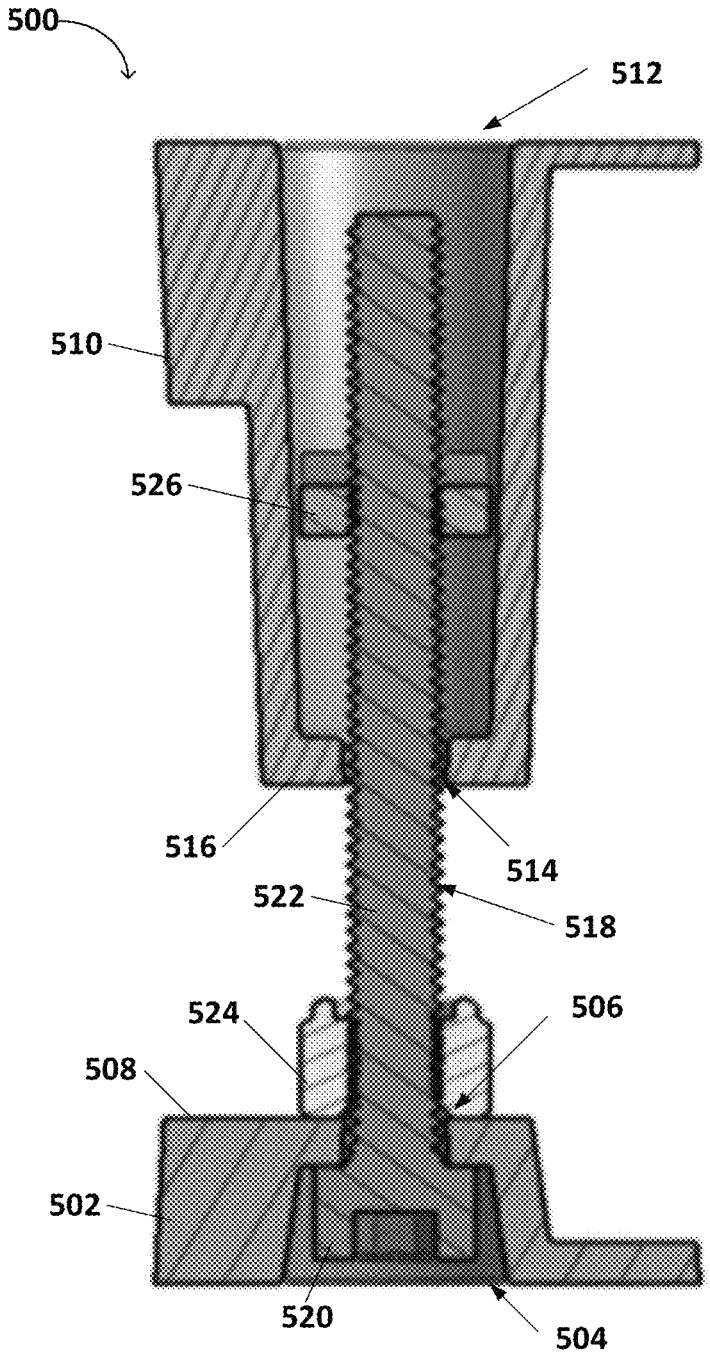

FIG. 5D depicts an example of the compression tool 500 following removal of the tightening tool and the spacer, as depicted and described with reference to FIGS. 5B and 5C. As depicted in this example, the tightening nut 526 is attached to the threaded body of the bolt and positioned within the cavity 512 of the second clamp component 510, therein providing a compression on the substack layers positioned between the two clamp components.

In certain examples, the compression tool 500 may include a lifting mechanism configured to transport the substack.

Figure 5E:
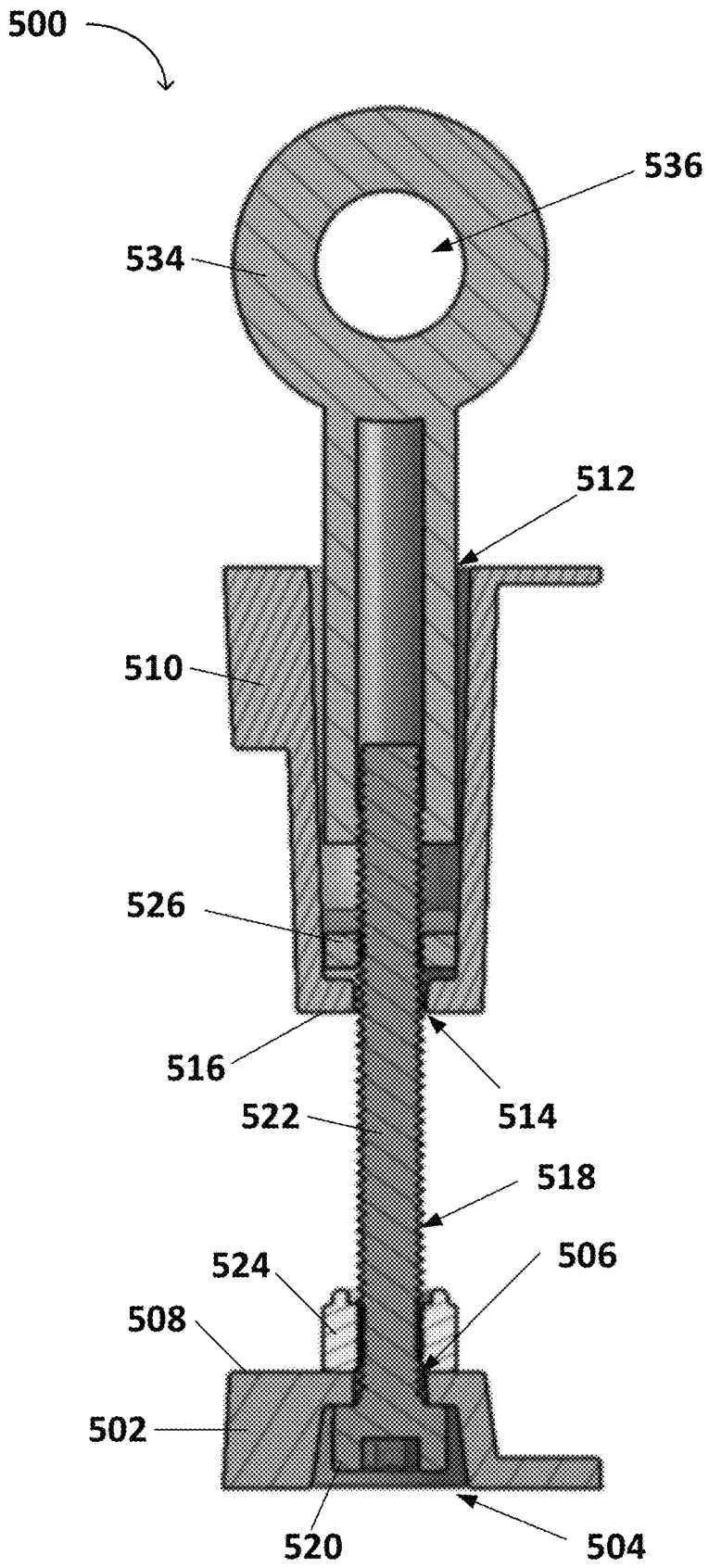

FIG. 5E depicts an example of such a lifting mechanism 534. In this example, the lifting mechanism 534 may be configured to threaded onto the thread of the bolt 518 at a second end of the bolt opposite the first end/head 520. In certain examples, the lifting mechanism 534 may include an eyelet, hook, or other latching element 536 configured to provide an attachment point for securing a separation lifting component to the compression tool 500 to assist moving or lifting the substack and attached compression tool 500, e.g., for loading or removing the substack from the overall stack. In certain examples, the lifting mechanism 534 may be configured to be removed from the compression tool 500 after the substack has been added to the electrochemical stack assembly.

In certain alternative examples, the lifting mechanism 534 may be a fixed element attached to the first clamp component or the second clamp component.

Figure 6:
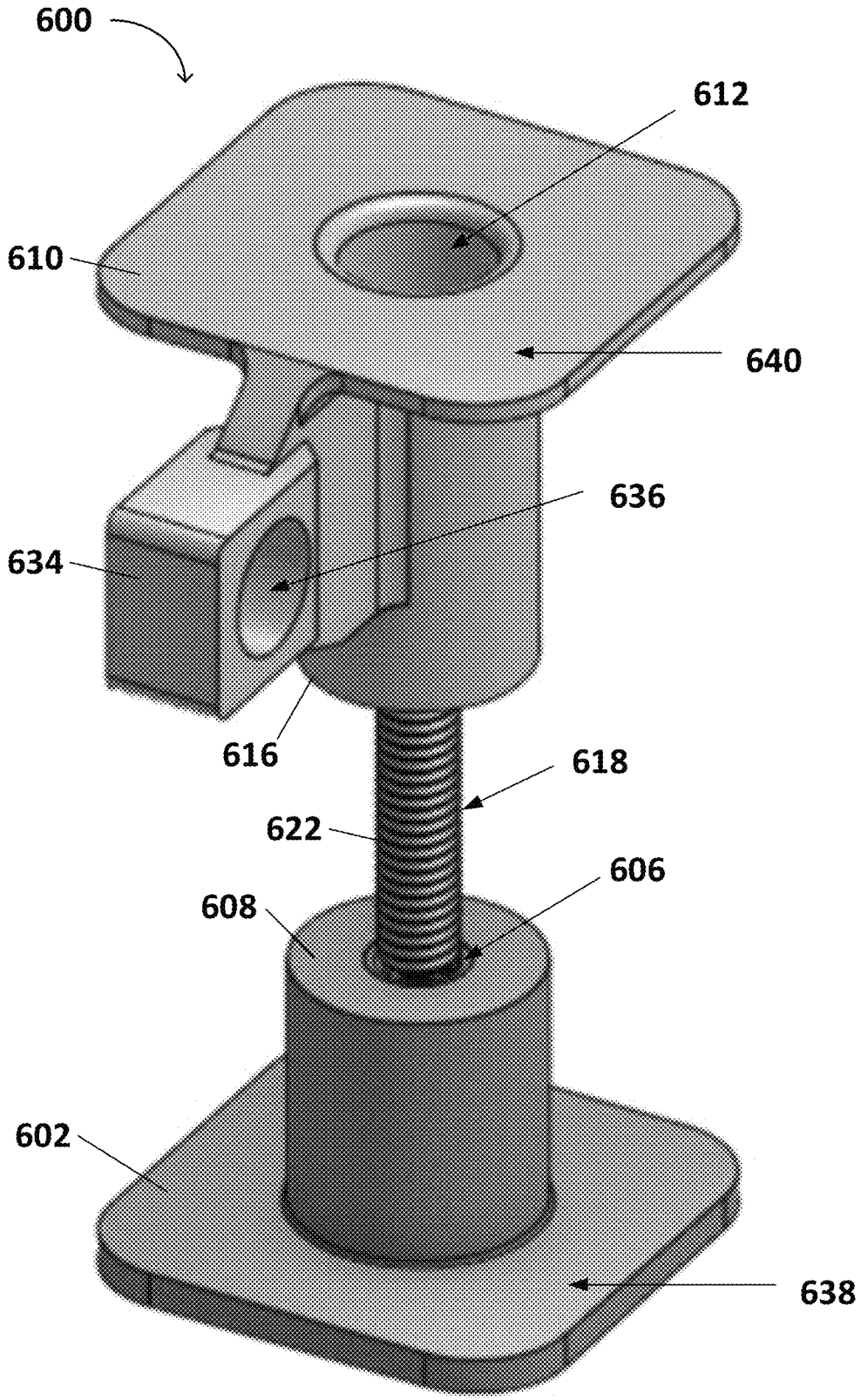
FIG. 6 depicts an additional example of a compression tool.

FIG. 6 depicts such an alternative embodiment of a compression tool having a fixed lifting mechanism. In this example, the compression tool includes a first clamp component, a second clamp component, and a bolt extending between the first and second clamp components. While not depicted in the figure, a lock nut and tightening nut may be present, as described above with FIGS. 5A-5E.

In this example, the lifting mechanism is fixed to the second clamp component. While not depicted, it is alternatively possible for the lifting mechanism to be fixed to the first clamp component instead.

FIG. 6 depicts an alternative example of a compression tool 600 having a lifting mechanism 634 permanently fixed to the compression tool 600. Similar to the example described in FIG. 5A, the compression tool 600 may include a first clamp component 602 having a first cavity (not depicted) and a hole 606 as a base 608 of the first cavity. The compression tool 600 may also include a second clamp component 610 having a second cavity 612 and a hole (not depicted) at a base 616 on the second cavity 612. In certain examples, a depth of the second cavity (as measured in a direction from the first plate to the second plate or a direction from the second clamp component to the first clamp component) may be greater than a depth of the first cavity.

The compression tool may include a fastener 618 (e.g., bolt or machined stud) configured to connect the first and second clamp components 602, 610 with each other, therein assisting in securing or holding the substack positioned between the two clamp components. In certain examples, the fastener 618 may include a thread 622 extending along at least a portion of the body of the machined stud or bolt.

Further, the fastener 618 may include a retaining component such as a ring, clip, or nut used in conjunction with the machined stud or bolt to fasten the parts together. In certain examples, the retaining ring or clip may be a c-clip. In other examples, the nut may be a dome nut, hex nut, or flange nut, for example.

As noted above, in this example of a compression tool 600, the lifting mechanism 634 is permanently attached or fixed to the second clamp component 610. In alternative examples, the lifting mechanism may be permanently fixed to the first clamp component 602. As depicted in FIG. 6, the lifting mechanism 634 may include a latching element 636 such as an eyelet. Alternatively, a hook or other latching element may be present to provide an attachment point for assisting in moving or lifting the substack and attached compression tool 600, e.g., for loading or removing the substack from the overall stack. The lifting mechanism 634 may extend in a direction perpendicular to the bolt 618 (i.e., parallel with the electrochemical cell layers within the substack), extending outward from the plurality of electrochemical cells within the substack. This orientation is advantageous in allowing the lifting mechanism 634 to remain fixed or otherwise attached to the compression tool 600 without interfering in the operation of the substack. Further, the outward orientation provides an easy access or latch point to remove the substack from the overall stack.

As depicted in FIG. 6, the first clamp component 602 and the second clamp component 610 may each have a rectangular or square shaped portion 638, 640 configured to fit within a similarly shaped rectangular or square shaped recess or pocket on an outer surface of the respective plate of the substack. Alternatively shaped configurations are also possible.

Figure 7A:
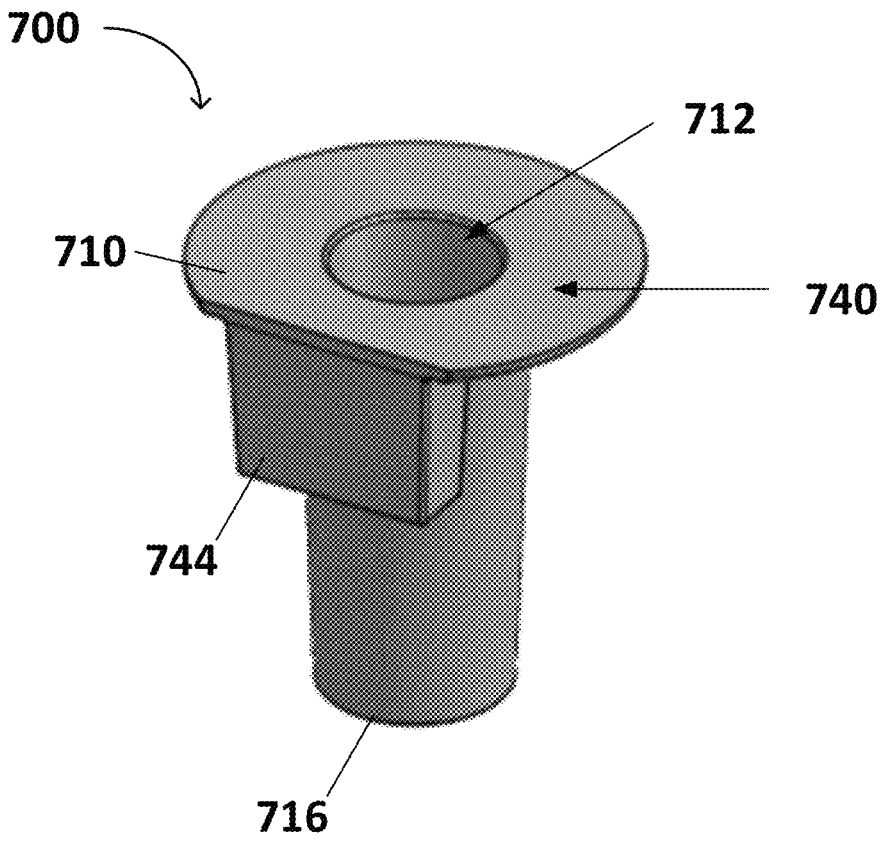
FIGS. 7A-7D depict an additional example of a compression tool and compression tool components, such as a first clamp component and a second clamp component, each having a circular or oval-shaped portion configured to fit into a respective recess or pocket on the outer surface of a substack plate.
Figure 7B:
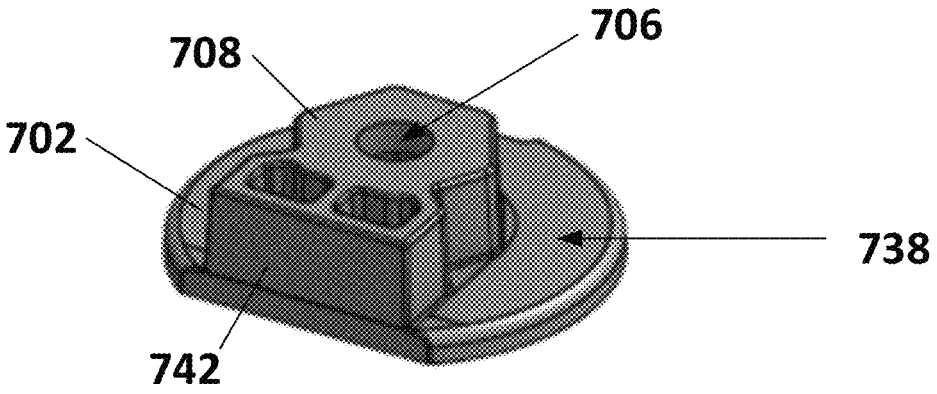

FIGS. 7A-7D depict an additional example of a compression tool 700. For example, FIGS. 7A and 7B depict portions of a compression tool 700 that include a first clamp component 702 and a second clamp component 710. The first clamp component 702 in FIG. 7B includes a first cavity (not depicted) and a hole 706 as a base 708 of the first cavity. FIG. 7A depicts the second clamp component 710 having a second cavity 712 and a hole (not depicted) at a base 716 on the second cavity 712.

In this example of a compression tool 700, the first clamp component 702 and second clamp component 710 each includes a circular or oval-shaped portion 738, 740 that is configured to fit into a respective recess or pocket on the outer surface of a substack plate. This may be advantageous in retaining the clamp component within the recess after compression, as the circular/oval shape prevents the clamp component from sliding out of the side of the stack after being compressed.

As depicted in FIGS. 7A and 7B, the first and second clamp components 702, 710 may have a truncated or flat portion 742, 744 of the circular/oval shape of the clamp component. This flat or truncated section/portion 742, 744 of the clamp component may be positioned on the outer edge of the substack when the clamp component 702, 710 is added to the substack and compressed. This may be advantageous in arranging the clamp component in a specific orientation and additionally not having the clamp component extend beyond an outer edge of the substack.

Figure 7C:
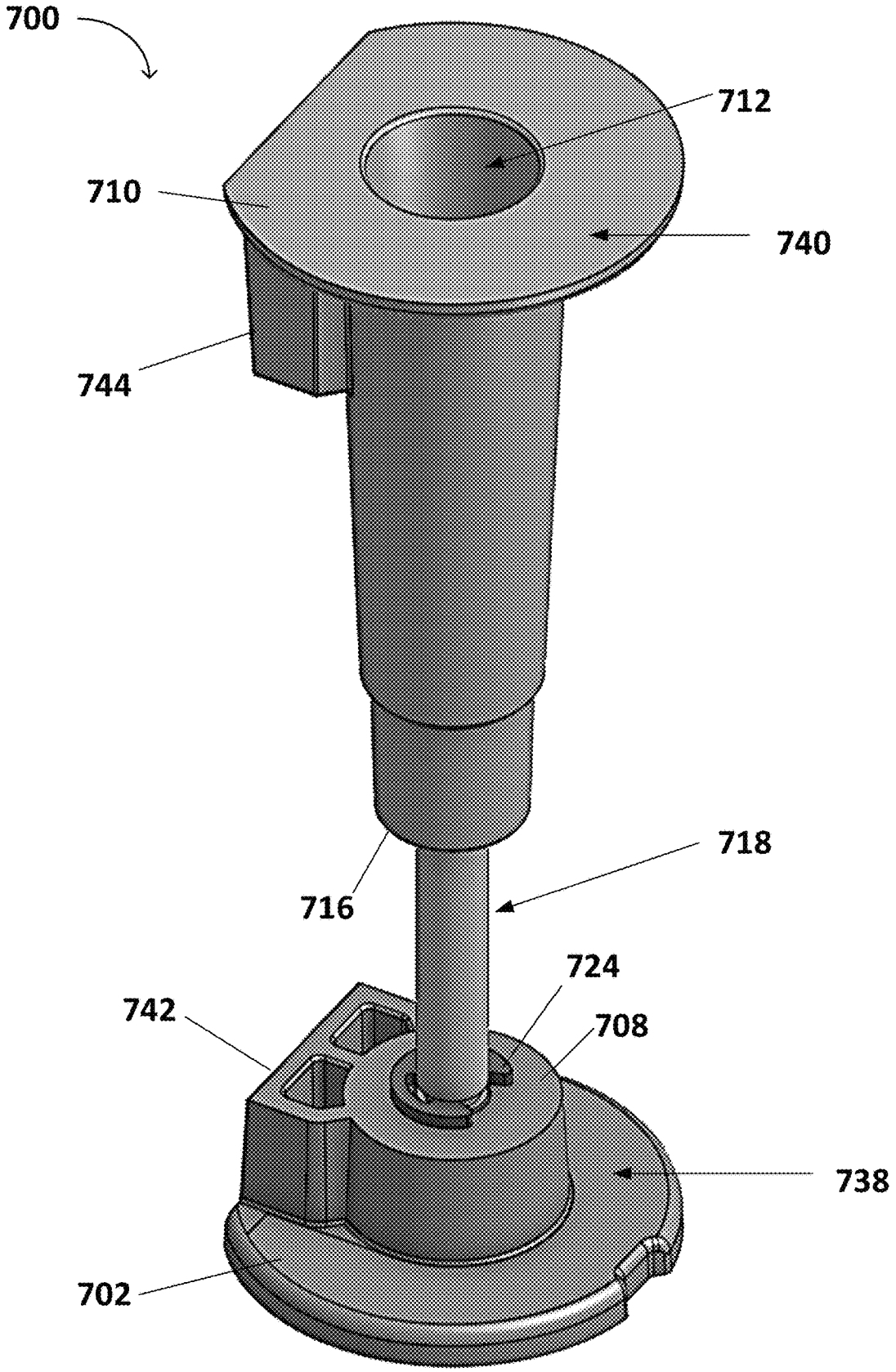

FIG. 7C depicts additional components forming the compression tool 700 that include the first and second clamp components 702, 710 from FIGS. 7A and 7B. In this example, FIG. 7C further depicts a fastener 718 configured to connect the first and second clamp components 702, 710 with each other, therein assisting in securing or holding the substack positioned between the two clamp components. In certain examples, the fastener 718 may include a machined stud or a bolt (e.g., having a thread extending along at least a portion of the body of the machined stud or bolt).

Further, the fastener 718 may include a retaining component 724 such as a ring, clip, or nut used in conjunction with the machined stud or bolt to fasten the parts together. As depicted in this example in FIG. 7C, the retaining component is a c-clip.

Figure 7D:
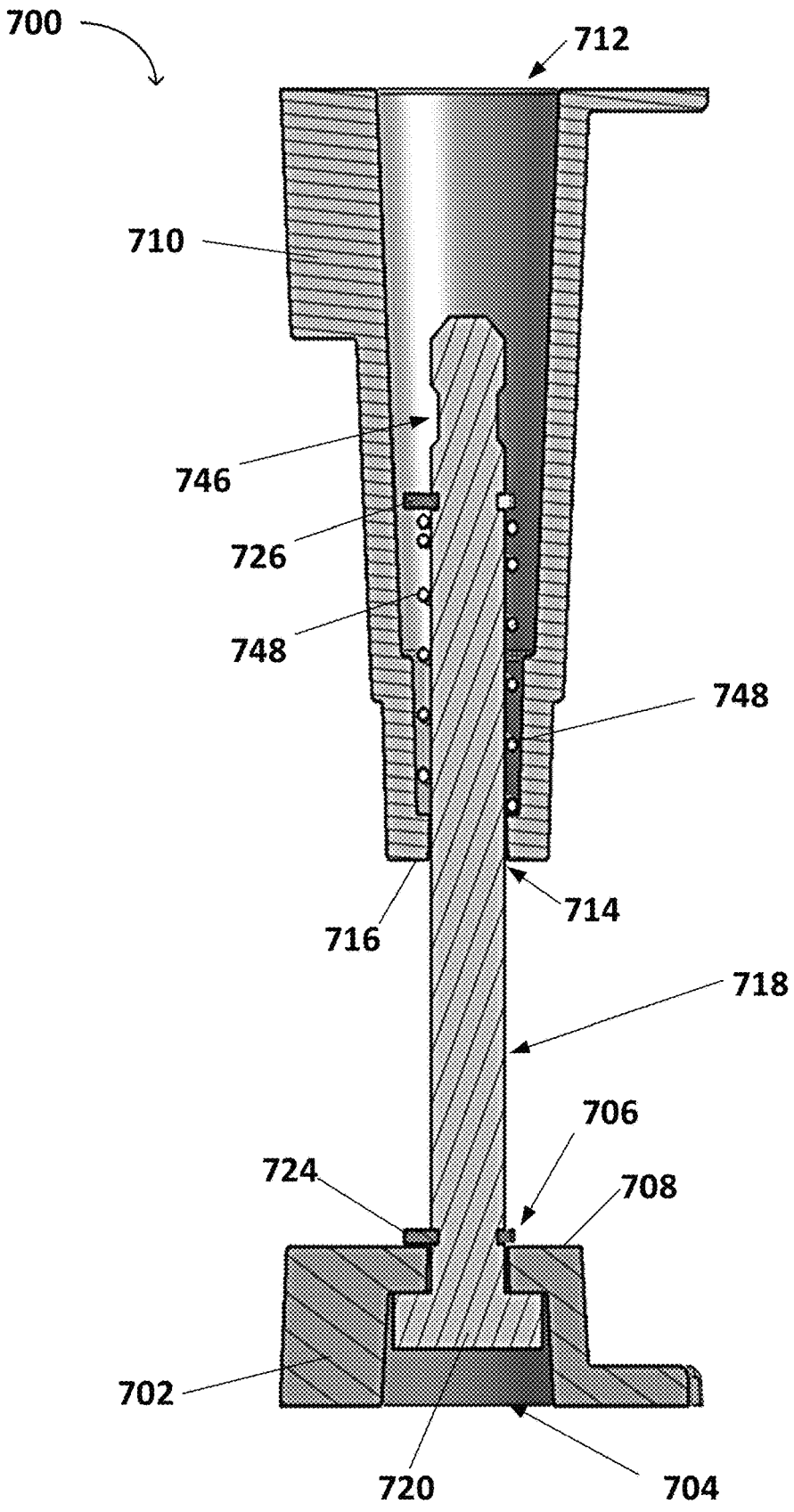

FIG. 7D depicts an additional cross-sectional view of the compression tool 700 of FIG. 7C. In this figure, the compression tool includes the first clamp component 702 having a first cavity 704 and a hole 706 as a base 708 of the first cavity 704. The compression tool 700 further includes the second clamp component 710 having a second cavity 712 and a hole 714 at a base 716 on the second cavity 712.

The compression tool includes the fastener 718 configured to connect the first and second clamp components 702, 710 with each other, therein assisting in securing or holding the substack positioned between the two clamp components. In certain examples, the fastener 718 may include a machined stud or a bolt (e.g., having a thread extending along at least a portion of the body of the machined stud or bolt). Further, the fastener 718 includes a c-clip retaining component 724.

As depicted in FIG. 7D, the bolt 718 includes a head 720 at a first end of the bolt and a thread extending along at least a portion of a body of the bolt. The body of the bolt 718 may be configured to be positioned through the hole 706 of the first clamp component 702 and the hole 714 of the second clamp component 710, and the head 720 of the bolt 718 may be positioned within the first cavity 704 of the first clamp component 702.

In this example, near an opposite end of the head 720 of the fastener or bolt 718, the fastener/bolt 718 includes a notch or cavity 746 in a surface of the threaded fastener 718. In certain examples, the notch may be present and extend around or circumnavigate the entire diameter of the fastener 718. In other alternative embodiments, the notch 746 may include one or more notches or cavities, each of which extends around only a portion of the diameter of the fastener 718. The notch or notches present in the fastener may be advantageous providing a quick connect interface with a lifting mechanism, such as depicted in FIG. 5E.

The compression tool may include a second retaining component (i.e., c-clip) 726 that may be configured to be attached to the bolt 718 and positioned within the second cavity 712 of the second clamp component 710 such that the hole 714 at the base 716 of the second cavity 712 may be positioned between the first clamp component 702 and the retaining component/c-clip 726. The positioning of the c-clip 726 may be configured to be adjusted on the bolt 718 within the second cavity 712 to provide a first compression of the plurality of electrochemical cells within the substack outside of an electrochemical stack assembly having a plurality of substacks. In other words, the positioning of the c-clip 726 on the body of the bolt 718 may be adjusted to provide or modify a desired compression on the substack positioned between the two clamp components connected by the fastener/bolt 718.

In certain examples, as noted above for FIG. 7C, the compression tool 700 may include a lock nut or c-clip 724 that may be configured to be attached to the bolt 718 to secure the first clamp component 702 between the head 720 of the bolt 718 and the c-clip 724.

In this example depicted in FIG. 7D, the compression tool further includes a spring or spring mechanism 748 that may be advantageous in providing a preload to the compression tool to assist in installation of the compression tool on the substack. In this example, the spring 748 is positioned around the outer circumference of the bolt 718 within the second cavity 712 of the second clamp component 710, between the base 716 of the second cavity 712 and the c-clip/retaining component 726.

Compression Tool Coupled to a Substack

As noted above, the first and second plates of the substack may each include an opening having a recess or pocket in the outer surface at an edge of the respective plate to receive and secure a clamp component of the compression tool.

Figure 8A:
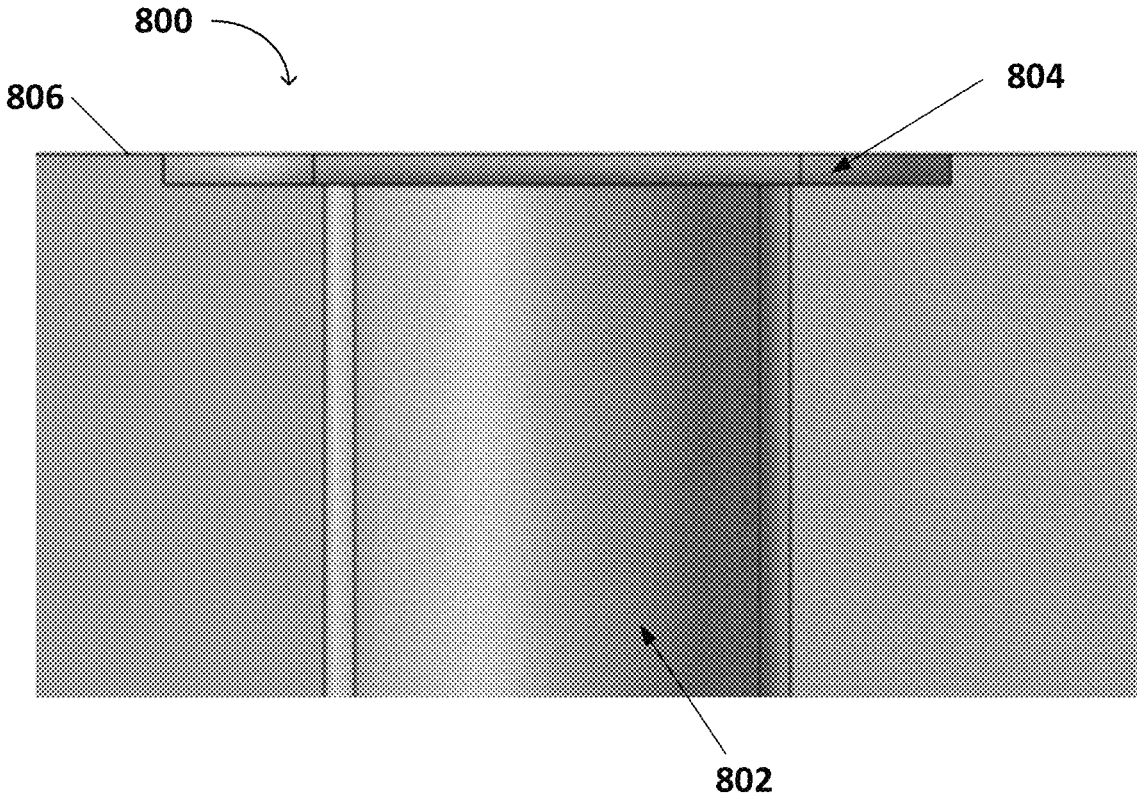
FIGS. 8A and 8B depict examples of plates of a substack having openings in the plates, wherein each opening has a recess or pocket within the outer edge of the plate.
Figure 8B:
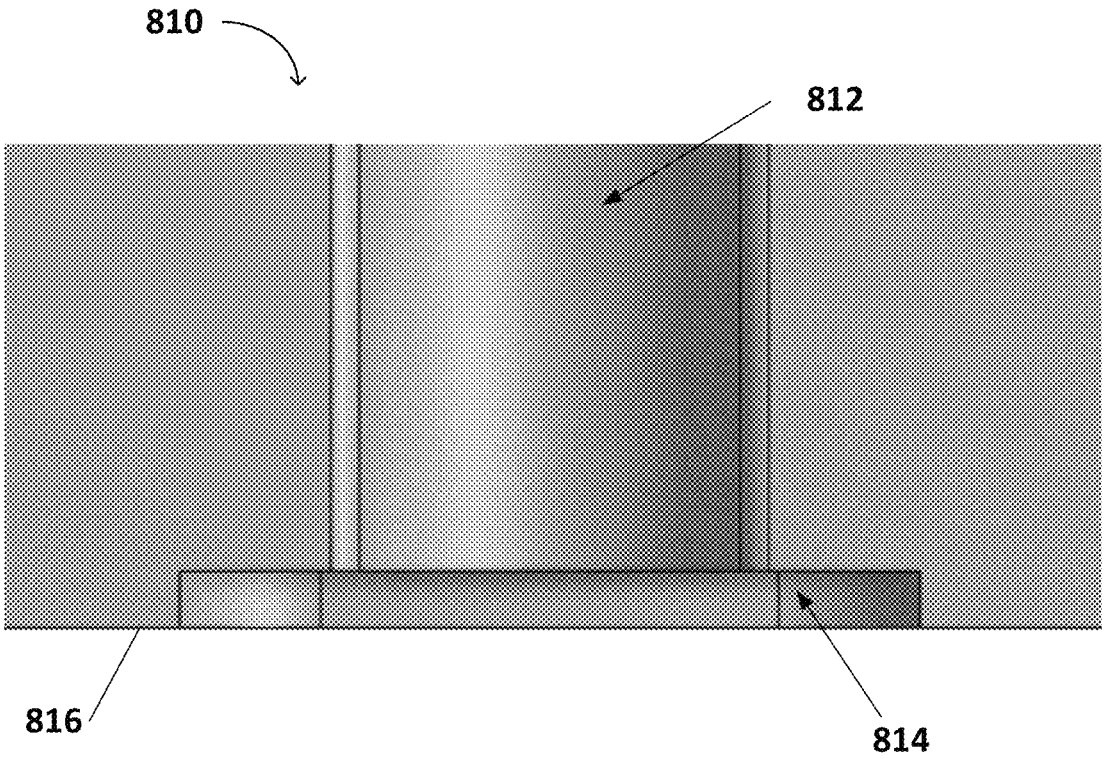

FIGS. 8A and 8B depict such examples of openings having recesses or pockets within the outer edges of the plates. Specifically, FIG. 8A depicts a first plate 800 having a first opening 802 with a first recess or pocket 804 in an outer edge 806 of the first plate 800 that is configured to receive one of the clamp components, while FIG. 8B depicts a second plate 810 having a second opening 812 with a second recess or pocket 814 in an outer edge 816 of the second plate 810 that is configured to receive the other of the two clamp components.

In these examples, the opening 802, 812 extends through the depth or height of the respective plate to receive the respective component. Further, the opening 802, 812 includes a recess 804, 814 positioned on an outer edge 806, 816 of the plate 800, 810 that is wider than the remaining portion of the opening. This may be advantageous in retaining or preventing the clamp component from sinking into the opening of the plate beyond its desirable location. Further, this recess 804, 814 is configured to align with the shape of the portion of the clamp component to secure the clamp component within the plate. Additionally, and advantageously, the recess 804, 814 is designed and configured such that no portion of the clamp component extends beyond an outer edge 806, 816 of the plate 800, 810. This is advantageous for allowing the compression tool to remain fixed to the substack after installation in the overall stack of the electrochemical plant or system, as the compression tool does not add any height to the substack and does not restrict installation of further substacks within the overall stack.

Figure 9A:
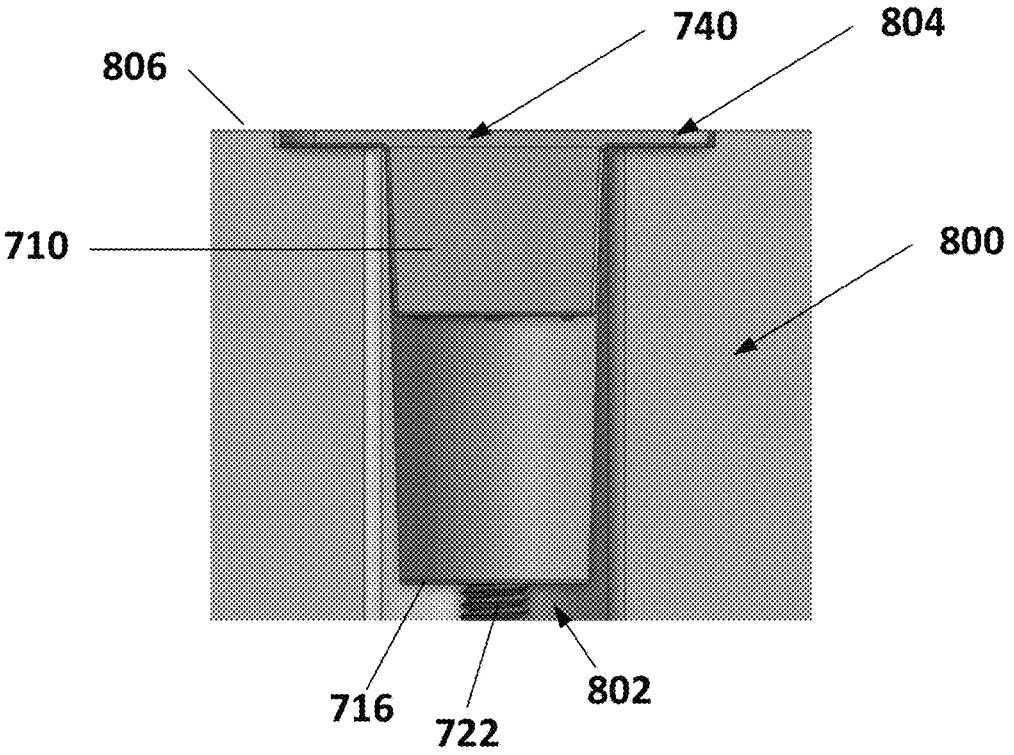
FIGS. 9A-9D depict examples of clamp components positioned within the openings of the plates depicted in FIGS. 8A and 8B.
Figure 9B:
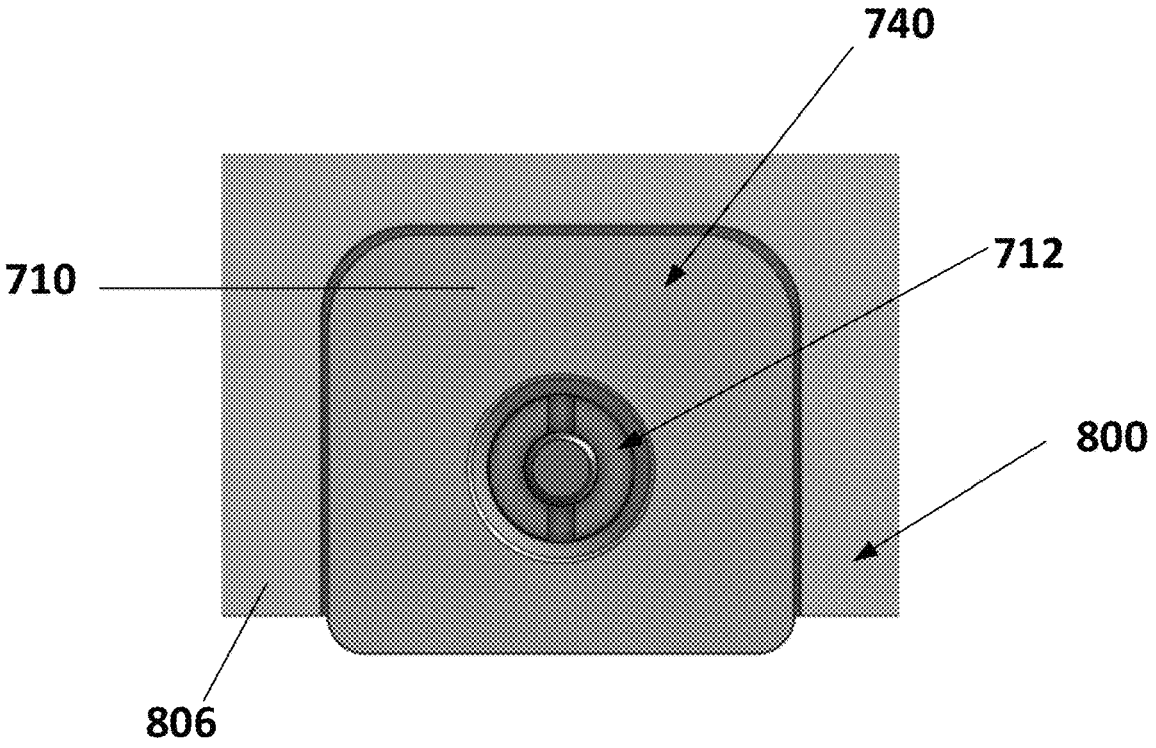

Furthermore, FIGS. 9A and 9B depict an example of a second clamp component 710 positioned within the opening of a second plate 800 depicted in FIG. 8A. FIG. 9A depicts a side view while FIG. 9B depicts a top view of the clamp component 710 within the opening 802. In this example, the second clamp component 710 has a rectangular or square shaped portion 740 configured to fit within a similarly shaped recess or pocket 804 of the opening 802 in the plate 800. As noted above, other shapes are possible, and the clamp component may have a circular or oval portion that fits in a similarly shaped recess/pocket of the opening in the plate. As noted above, the clamp component 710 is configured to be positioned within the recess or pocket 804 of the plate 800 such that the outer surface of the clamp component 710 does not extend beyond the outer edge/surface 806 of the plate 800.

Figure 9C:
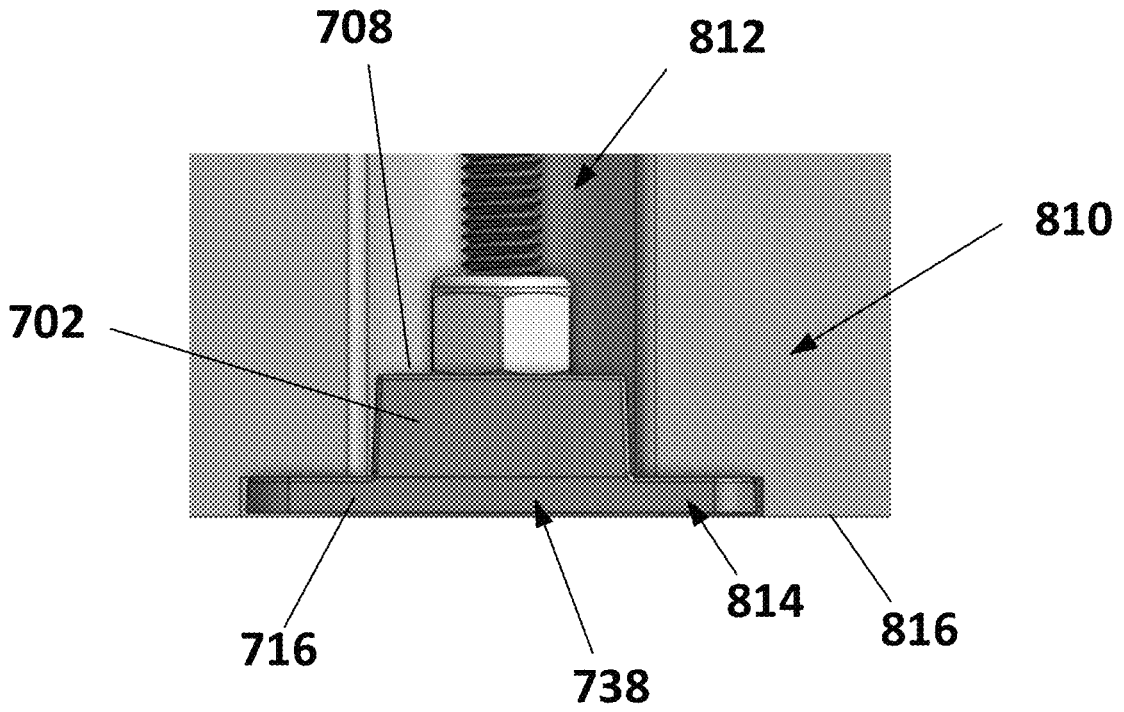
Figure 9D:
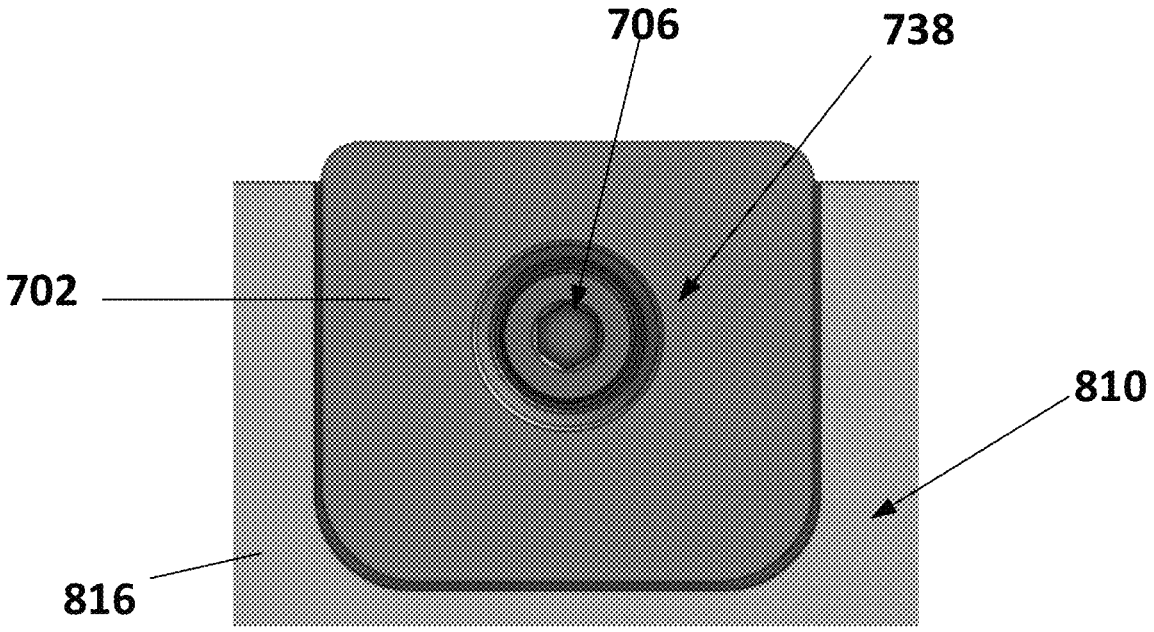

Additionally, FIGS. 9C and 9D depict an example of a first clamp component 702 positioned within the opening 812 of the first plate 810 depicted in FIG. 8B. FIG. 9C depicts a side view while FIG. 9D depicts a top view of the clamp component 702 within the opening 812. In this example, the clamp component 702 has a rectangular or square shaped portion 738 configured to fit within a similarly shaped recess or pocket 814 of the opening 812 in the plate 810. As noted above, other shapes are possible, and the clamp component may have a circular or oval portion that fits in a similarly shaped recess/pocket of the opening in the plate. Furthermore, the clamp component 702 is configured to be positioned within the recess or pocket 814 of the plate 810 such that the outer surface of the clamp component 702 does not extend beyond the outer edge/surface 816 of the plate 810.

Figure 10A:
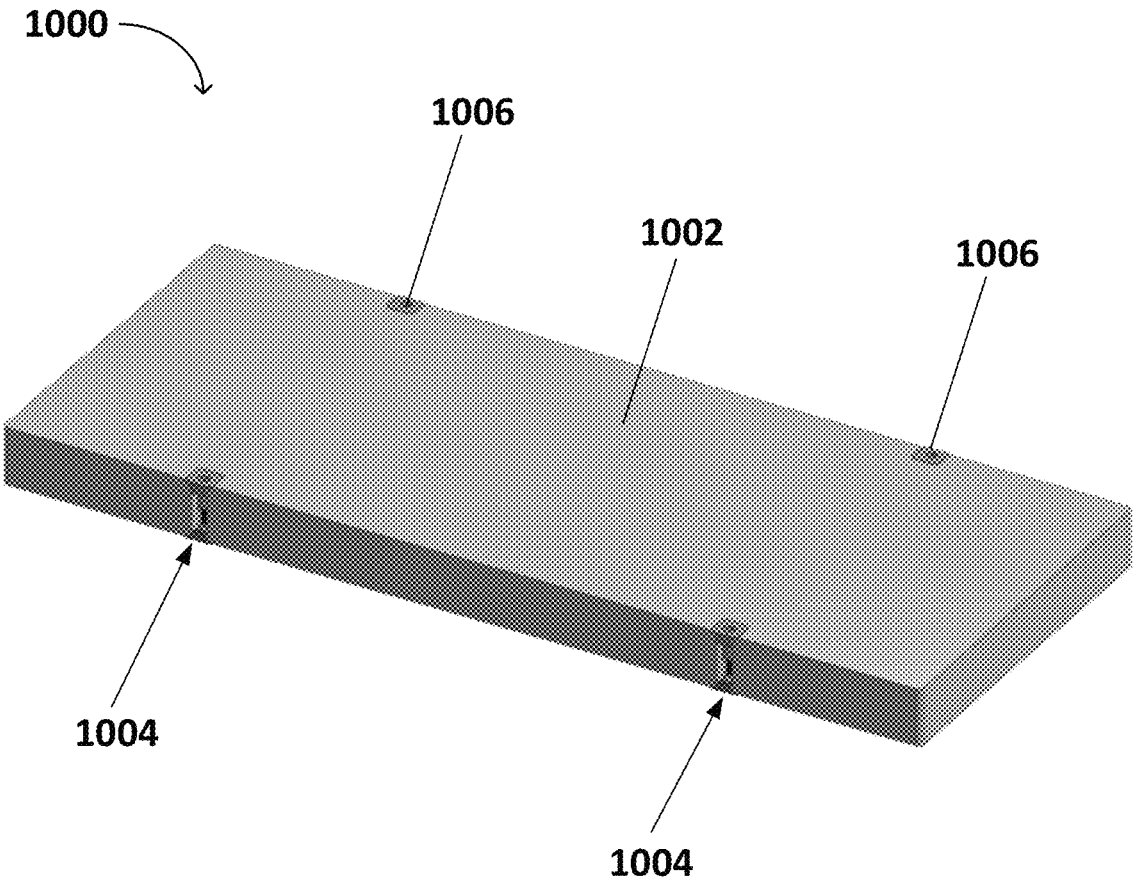
FIGS. 10A-10C depict an example of a substack coupled with a plurality of compression tools.
Figure 10B:
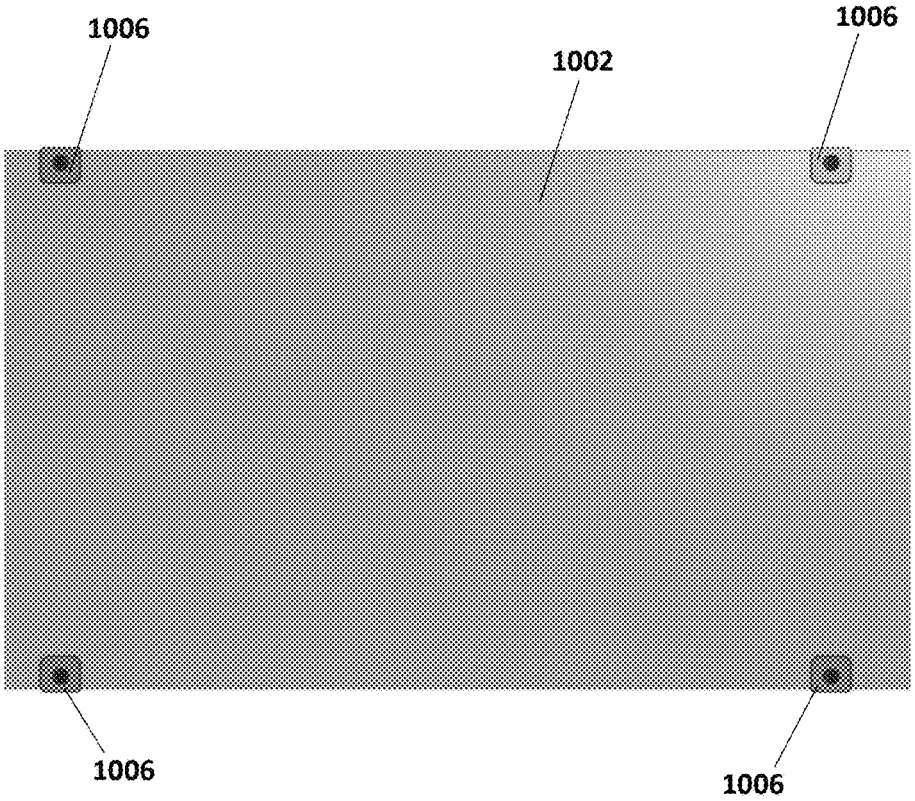
Figure 10C:
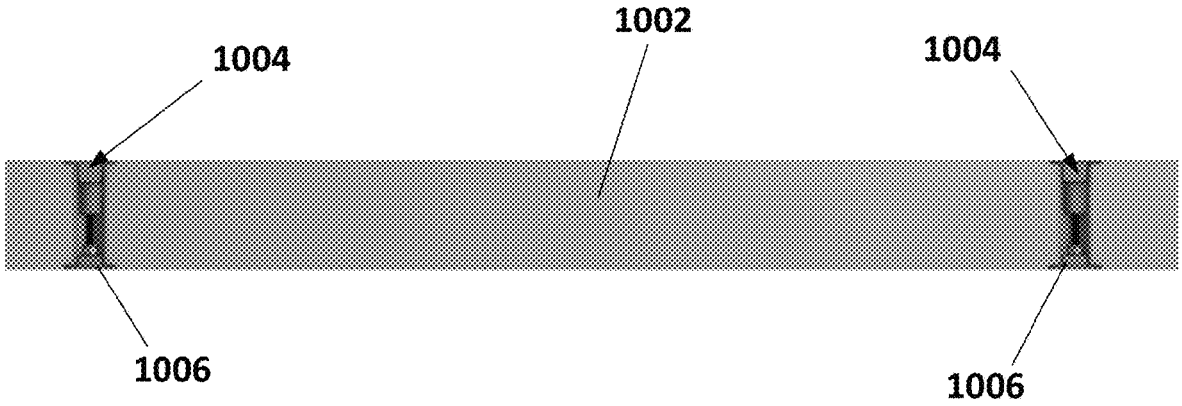

FIGS. 10A-10C depict an example 1000 of a substack 1002 for an electrochemical stack having a plurality of electrochemical cells, a first plate, and a second plate, wherein the electrochemical cells are positioned between the first plate and the second plate. Specifically, FIG. 10A depicts an isometric view of a substack 1002 having a plurality of openings or cutouts 1004 (i.e., 4) within the substack perimeter and a respective compression tool 1006 positioned within each respective opening. The compression tool may be an embodiment as identified and described above with reference to FIGS. 5A-9D above.

Each opening or cutout 1004 allows for portions of the first and second clamp components as well as the bolt extending between the two clamp components to be positioned within the respective opening. Additionally, as noted above, the first and second plates of the substack also include recesses or pockets within the outer surfaces of the plates allowing the respective clamp component to be secured within the recess/pocket and not protrude outward beyond the outer surface of the respective plate of the substack 1002.

FIG. 10B depicts a top view of the substack of represented in FIG. 10A and FIG. 10C depicts a side view of the substack represented in FIG. 10A.

In this particular example in FIGS. 10A-10C, there are four compression tools 1006 attached to and providing compression to the substack 1002. More or fewer compression tools are possible.

The location of each compression tool 1006 is also configurable. In one example, compression tools are provided only on the long sides of the rectangular shaped substack 1002, such as depicted in FIGS. 10A-10C. For example, a plurality of compression tools (e.g., at least two) are positioned on each long side of the substack. In certain examples, such as shown in FIGS. 10A-10C, each compression tool on one long side of the substack is matched with a similarly positioned compression tool on the opposite long side of the substack. Alternatively, the positioning of each compression tool does not need to match or mirror the positioning of another compression tool's location.

In an alternative example, compression tools may be positioned only on the short sides of the rectangular shaped substack. In further alternative examples, compression tools may be positioned on three or four sides of the substack.

As noted above, these compression tools are advantageously configured to be maintained on the substack after the substack is added to the electrochemical stack assembly and the electrochemical stack assembly commences operation of an electrolysis reaction.

Methods of Forming a Substack for an Electrochemical Stack

Figure 11:
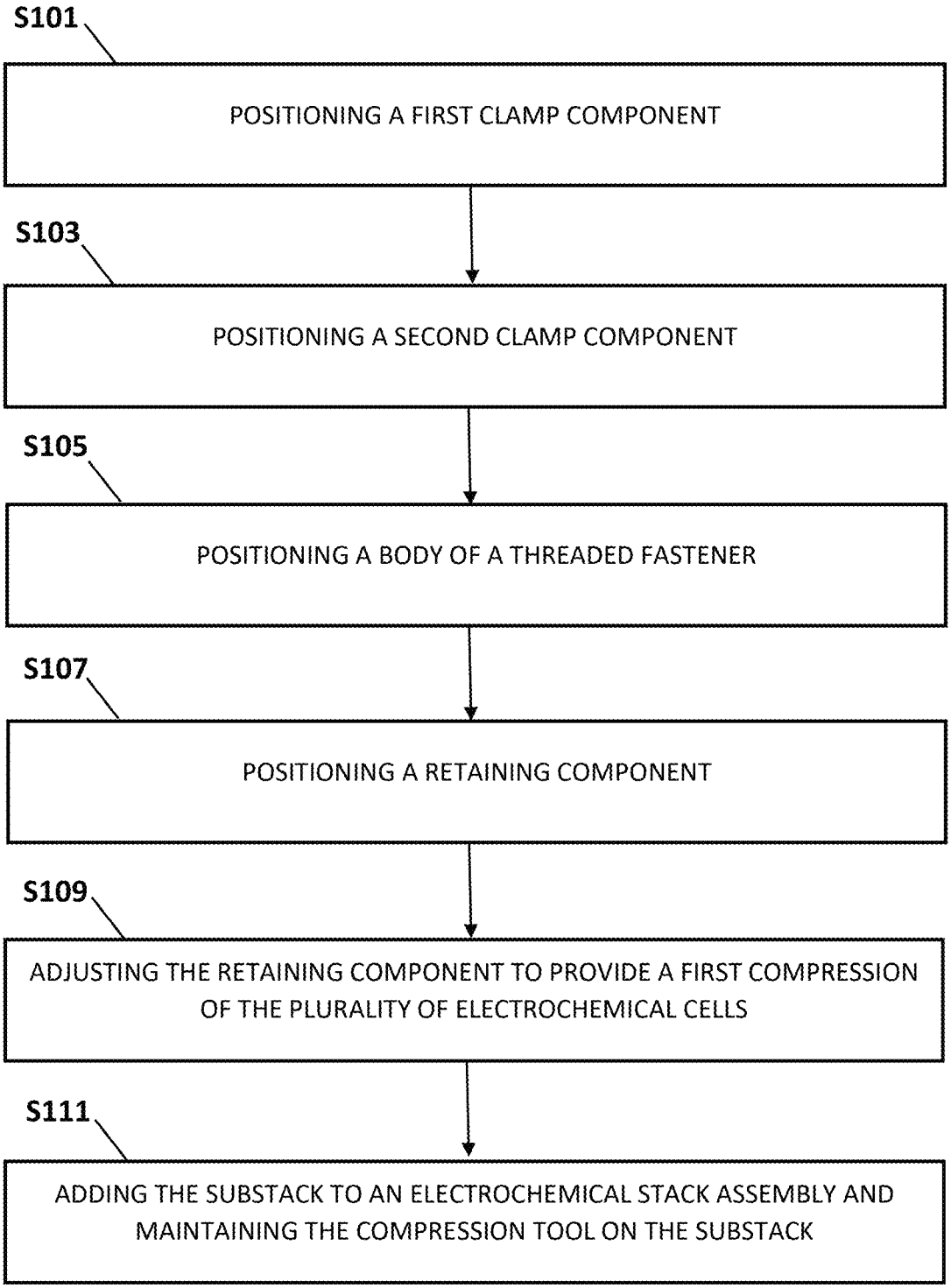
FIG. 11 depicts a flow chart describing a method for forming a substack with a compression tool.

FIG. 11 depicts a flowchart describing an example process of forming a substack of an electrochemical stack. In such an example, a substack is provided that includes a plurality of electrochemical cells, a first plate, and a second plate, wherein the plurality of electrochemical cells is positioned between the first and second plates.

In act S101, the method includes positioning a first clamp component having a first cavity and a hole at a base of the first cavity, within a recess on an outer surface of the first plate of the substack and positioning the first cavity toward a second clamp component.

In act S103, the method further includes positioning the second clamp component having a second cavity and a hole at a base on the second cavity wherein a depth of the second cavity is greater than a depth of the first cavity, within a recess on an outer surface of the second plate of the substack and positioning the hole at the base of the second cavity toward the first clamp component.

In act S105, the method further includes positioning a body of a threaded fastener (e.g., bolt or stud) having a head at a first end of the threaded fastener and thread extending along at least a portion of a body of the threaded fastener, through the hole of the first clamp component and the hole of the second clamp component and positioning the head of the threaded fastener within the first cavity of the first clamp component.

In act S107, the method further includes positioning a retaining component (e.g., tightening nut or clip) onto the thread of the threaded fastener within the second cavity of the second clamp component. The method further includes positioning the hole at the base of the second cavity between the first clamp component and the retaining component.

In act S109, the method further includes adjusting the retaining component in the thread of the threaded fastener within the second cavity to provide a first compression of the plurality of electrochemical cells within the substack outside of an electrochemical stack assembly having a plurality of substacks.

In act S111, the method further includes adding the substack to the electrochemical stack assembly, wherein the compression tool is maintained on the substack after the substack is added to the electrochemical stack assembly and the electrochemical stack assembly commences operation of an electrolysis reaction.

In certain examples, the method may include threading a lock nut onto the thread of the threaded fastener and securing the first clamp component between the head of the threaded fastener and the lock nut.

In certain examples, the method may include threading a tightening tool onto the thread of the threaded fastener at a second end of the threaded fastener opposite the first end, tightening the retaining component (e.g., tightening nut or clip) to a predetermined height, and providing the first compression of the plurality of electrochemical cells of the substack. The method may include removing the tightening tool after the substack has been compressed to the predetermined height.

In certain examples, the method may include inserting a spacer into an opening between the first clamp component and the second clamp component to set the predetermined height. The method may include removing the spacer after the substack has been compressed to the predetermined height.

In certain examples, the method may include transporting the substack using a lifting mechanism. The method may include threading the lifting mechanism onto the thread of the threaded fastener at a second end of the threaded fastener opposite the first end. The method may include attaching the lifting mechanism to the first clamp component or the second clamp component and extending the lifting mechanism in a direction perpendicular to the threaded fastener. The method may include removing the lifting mechanism after the substack has been added to the electrochemical stack assembly.

In certain examples, the method may include maintaining alignment of cell layers within the plurality of electrochemical cells in the substack.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

As used herein, the singular forms "a," "an," and "the" include plural referents unless the context clearly dictates otherwise.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the disclosure. The claims should not be read as limited to the described order or elements unless stated to that effect. Therefore, all embodiments that come within the scope and spirit of the following claims and equivalents thereto are claimed as the disclosure.

The invention claimed is:

1. A compression tool for compressing a substack of electrochemical cells having a first plate, a second plate, and a plurality of electrochemical cells positioned between the first plate and the second plate, the compression tool comprising:

a first clamp component having a first cavity and a hole at a base of the first cavity, wherein the first clamp component is configured to be positioned within a recess on an outer surface of the first plate of the substack such that the hole at the base of the first cavity is positioned toward a second clamp component of the compression tool;

the second clamp component having a second cavity and a hole at a base on the second cavity, wherein a depth of the second cavity is greater than a depth of the first cavity, wherein the second clamp component is configured to be positioned within a recess on an outer surface of the second plate of the substack such that the hole at the base of the second cavity is positioned toward the first clamp component;

a fastener having a head at a first end and a body, wherein the body is configured to be positioned through the hole of the first clamp component and the hole of the second clamp component, and wherein the head is positioned within the first cavity of the first clamp component; and a retaining component configured to be attached to or threaded onto a thread of the fastener and positioned within the second cavity of the second clamp component such that the hole at the base of the second cavity is positioned between the first clamp component and the retaining component, wherein the retaining component is configured to be adjusted on the fastener within the second cavity to provide a first compression of the plurality of electrochemical cells within the substack outside of an electrochemical stack assembly having a plurality of substacks; and wherein the compression tool is configured to be maintained on the substack after the substack is added to the electrochemical stack assembly and the electrochemical stack assembly commences operation of an electrolysis reaction.

2. The compression tool of claim 1, further comprising:

a lock nut or clip configured to be attached to or threaded onto the fastener to secure the first clamp component between the head of the fastener and the lock nut or the clip.

3. The compression tool of claim 1, wherein the retaining component is a tightening nut or clip.

4. The compression tool of claim 3, further comprising:

a tightening tool configured to thread onto the fastener at a second end of the fastener opposite the first end and tighten the tightening nut to a predetermined height to provide the first compression of the plurality of electrochemical cells of the substack, wherein the tightening tool is configured to be removed from the compression tool after the substack has been compressed to the predetermined height.

5. The compression tool of claim 4, further comprising:

a spacer configured to be inserted into an opening between the first clamp component and the second clamp component to set the predetermined height, wherein the spacer is configured to be removed from the compression tool after the substack has been compressed to the predetermined height.

6. The compression tool of claim 1, further comprising:

a lifting mechanism configured to transport the substack.

7. The compression tool of claim 6, wherein the lifting mechanism is configured to attach or thread onto the fastener at a second end of the fastener opposite the first end, and wherein the lifting mechanism is configured to be removed from the compression tool after the substack has been added to the electrochemical stack assembly.

8. The compression tool of claim 6, wherein the lifting mechanism is permanently attached to the first clamp component or the second clamp component and extends in a direction perpendicular to the fastener.

9. The compression tool of claim 6, wherein the fastener comprises a notch near an end of the fastener, wherein the notch provides a quick connect interface with the lifting mechanism.

10. The compression tool of claim 1, wherein the fastener is a bolt or a machined stud.

11. The compression tool of claim 1, further comprising:

a spring positioned within the second cavity of the second clamp component around an outer circumference of the fastener between a base of the second cavity and the retaining component.

12. A substack for an electrochemical stack, the substack comprising:

a plurality of electrochemical cells;

a first plate; and a second plate, wherein the plurality of electrochemical cells is positioned between the first plate and the second plate; and a compression tool comprising:

a first clamp component having a first cavity and a hole at a base of the first cavity, wherein the first clamp component is positioned within a recess on an outer surface of the first plate of the substack such that the hole at the base of the first cavity is positioned toward a second clamp component of the compression tool;

the second clamp component having a second cavity and a hole at a base on the second cavity, wherein a depth of the second cavity is greater than a depth of the first cavity, wherein the second clamp component is positioned within a recess on an outer surface of the second plate of the substack such that the hole at the base of the second cavity is positioned toward the first clamp component;

a fastener having a head at a first end and a body, wherein the body is configured to be positioned through the hole of the first clamp component and the hole of the second clamp component, and wherein the head is positioned within the first cavity of the first clamp component; and a retaining component configured to be attached to or threaded onto the fastener and positioned within the second cavity of the second clamp component such that the hole at the base of the second cavity is positioned between the first clamp component and the retaining component, wherein the retaining component is configured to be adjusted on the fastener within the second cavity to provide a first compression of the plurality of electrochemical cells within the substack outside of an electrochemical stack assembly having a plurality of substacks; and wherein the compression tool is configured to be maintained on the substack after the substack is added to the electrochemical stack assembly and the electrochemical stack assembly commences operation of an electrolysis reaction.

13. The substack of claim 12, further comprising:

a lock nut or clip attached to or threaded onto the fastener to secure the first clamp component between the head of the fastener and the lock nut or the clip.

14. The substack of claim 12, wherein the retaining component is a tightening nut or clip.

15. The substack of claim 14, further comprising:

a tightening tool configured to thread onto the fastener at a second end of the fastener opposite the first end and tighten the tightening nut to a predetermined height to provide the first compression of the plurality of electrochemical cells of the substack, wherein the tightening tool is configured to be removed from the compression tool after the substack has been compressed to the predetermined height.

16. The substack of claim 15, further comprising:

a spacer configured to be inserted into an opening between the first clamp component and the second clamp component to set the predetermined height, wherein the spacer is configured to be removed from the compression tool after the substack has been compressed to the predetermined height.

17. The substack of claim 12, further comprising:

a lifting mechanism configured to transport the substack, wherein the lifting mechanism is configured to attach or thread onto the fastener at a second end of the fastener opposite the first end, and wherein the lifting mechanism is configured to be removed from the compression tool after the substack has been added to the electrochemical stack assembly.

18. The substack of claim 17, wherein the fastener comprises a notch near an end of the fastener, wherein the notch provides a quick connect interface with the lifting mechanism.

19. The substack of claim 12, further comprising:

a spring positioned within the second cavity of the second clamp component around an outer circumference of the fastener between a base of the second cavity and the retaining component.

20. The substack of claim 12, wherein the compression tool maintains an alignment of cell layers within the plurality of electrochemical cells in the substack.

* * * * *